US012546059B2

(12) United States Patent
Lin et al.

(10) Patent No.: US 12,546,059 B2
(45) Date of Patent: Feb. 10, 2026

(54) HANDHELD GARMENT STEAMER AND WATER TANK THEREOF

(71) Applicant: Shenzhen Tengben Technology Co., Ltd., Shenzhen Guangdong (CN)

(72) Inventors: Jianbo Lin, Shenzhen (CN); Shui Qing Huang, Shenzhen (CN); Zhongming Yu, Shenzhen (CN)

(73) Assignee: Shenzhen Tengben Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/942,706

(22) Filed: Nov. 10, 2024

(65) Prior Publication Data

US 2025/0154715 A1 May 15, 2025

Related U.S. Application Data

(63) Continuation-in-part of application No. 29/916,342, filed on Nov. 10, 2023, now Pat. No. Des. 1,089,910.

(51) Int. Cl.

| | |
|---|---|
| ***D06F 75/18*** | (2006.01) |
| ***D06F 75/34*** | (2006.01) |
| ***D06F 75/36*** | (2006.01) |

(52) U.S. Cl.

CPC ..... *D06F 75/18* (2013.01); *D06F 75/34* (2013.01); *D06F 75/36* (2013.01)

(58) Field of Classification Search

CPC ..... D06F 75/18; D06F 75/34; D06F 75/36; D06F 75/10; D06F 75/08; D06F 75/00; D06F 73/00

See application file for complete search history.

(56) References Cited

U.S. PATENT DOCUMENTS

| | | | | |
|---|---|---|---|---|
| 2017/0042294 | A1* | 2/2017 | Coe | A44B 11/266 |
| 2021/0156076 | A1* | 5/2021 | Man | D06F 73/00 |
| 2021/0169284 | A1* | 6/2021 | Royale | A47L 11/26 |
| 2021/0324571 | A1* | 10/2021 | Lai | D06F 75/16 |
| 2022/0195657 | A1* | 6/2022 | Leung | D06F 39/40 |

FOREIGN PATENT DOCUMENTS

| | | | | |
|---|---|---|---|---|
| CN | 209243440 | * | 8/2019 | D06F 73/00 |
| CN | 211689613 | * | 10/2020 | D06F 73/00 |
| CN | 212834665 | * | 3/2021 | D06F 73/00 |

OTHER PUBLICATIONS

Machine translation CN209243440 (Year: 2019).*
Machine translation CN211689613 (Year: 2020).*
Machine translation CN212834665 (Year: 2021).*

* cited by examiner

*Primary Examiner* — Uyen T Nguyen

(74) *Attorney, Agent, or Firm* — Che-Yang Chen

(57) ABSTRACT

A handheld garment steamer includes a housing, a water tank, an evaporation assembly and a water pump assembly, the housing includes a base housing portion and a head housing portion, the water tank is detachably mounted to the base housing portion in a manner that the water tank and the base housing portion form a handle part for a user to hold thereon.

19 Claims, 27 Drawing Sheets

A

B

HANDHELD GARMENT STEAMER AND WATER TANK THEREOF

CROSS REFERENCE OF RELATED APPLICATION

This application is a Continuation-In-Part application that claims the benefit of priority under 35U.S.C. § 120 to a non-provisional application, application Ser. No. 29/916,342, filed on Nov. 14, 2023, wherein the entire content of which is expressly incorporated herein by reference.

BACKGROUND OF THE PRESENT INVENTION

Field of Invention

The present invention relates to steamer for clothes, and more particularly to a handheld garment steamer and water tank thereof adapted for easy hand holding while ensuring a large capacity that can handle multiple garments in a single refill.

Description of Related Arts

A steamer is lightweight, portable, and simpler to use, especially for vertical steaming, which means clothes can be de-wrinkled while hanging. A garment steamer can quickly remove wrinkles without needing an ironing board, making it efficient for quick touch-ups and last-minute need. The steamer is ideal for delicate fabrics like silk, satin, and chiffon, as it does not apply direct heat or pressure, reducing the risk of damage or burns.

However, a conventional garment steamer either has a limited water tank capacity or have a large bulky size. As shown in FIG. 1 of the drawings, the conventional garment steamer comprises a steamer head portion 1, a housing portion 2 which is capable of storing water and a handle 3 connected to the housing portion 2. The housing portion 2 may provide a large volume of storing water. However, the bigger size of this conventional steamer by incorporating the independent handle 3 means it occupies more storage space, making it less convenient for those with limited space in their home or travel luggage, so that it is not ideal for compact storage or travel use.

As shown in FIG. 2 of the drawings, a conventional garment steamer comprises a steamer head portion 1, a housing portion 2 connected to the steamer head portion 1 and a water tank portion 4 connected to a bottom of the housing portion 2. As shown in FIG. 3 of the drawings, another conventional garment steamer comprises a steamer head portion 1, a housing portion 2 connected to the steamer head portion 1 for a user to hold and a water tank portion 4 connected to a rear end of the steamer head portion 1.

However, the water tank portions 4 of these conventional garment steamer generally have a small water storing volume which is about 120 ml, so that the small water tank portion 4 requires frequent refilling, which interrupts steaming sessions and can be inconvenient, especially for larger jobs or when steaming multiple garments. With less water, the steamer can only produce steam for a shorter duration, limiting the amount of work the user can do before needing to stop and refill. In addition, constant refilling slows down the overall process, making it less time-efficient. A small water tank portion 4 may not be practical for steaming curtains, bedding, or large quantities of clothing without multiple interruptions.

Generally, the water tank portion 4 of the conventional garment steamer is detachably mounted to the steamer head portion 1 or the housing portion 2. However, the water spills, especially when the water tank portion 4 is detached for refill, leads to user frustration and makes the steamer more difficult and less enjoyable to use.

In addition, a button-locking or clip-locking structure may be employed to ensure a firm and secure connection between the water tank portion 4 and the housing portion 2 or the steamer head portion 1. However, the presence of a visible button-locking or clip-locking mechanism of the conventional garment steamer may detract from the sleek and modern appearance, making the design look more bulky or mechanical, which may not appeal to users looking for an aesthetically pleasing product.

For a user who is unfamiliar with the mechanism, the additional step of pressing a button or clip to lock or unlock the water tank portion 4 may feel cumbersome or unintuitive, especially if the process is not clearly labeled or requires precise alignment. Over time, the conventional button-locking or clip-locking mechanism can wear out, become stuck, or break, especially with frequent use. A faulty button or clip could result in difficulty removing or reattaching the water tank, reducing the overall reliability of the steamer.

SUMMARY OF THE PRESENT INVENTION

The invention is advantageous in that it provides a handheld garment steamer and water tank thereof, wherein the water thank has a relatively large water storing volume, so as to allow the handheld garment steamer to handle increased number of garments in a single refill.

Another advantage of the present invention is to provide a handheld garment steamer and water tank thereof, wherein an upper portion of the water tank is configured to conform to the holding hand of the user, the ergonomic design ensures that the user's hand comfortably fits around the upper portion of the water tank, allowing for a more secure and comfortable grip as well as enhancing control over the steamer. The hand-conforming shape simplifies holding and maneuvering the steamer, particularly during vertical steaming or when handling delicate garments. It enhances the overall user experience by making the device more intuitive to handle.

Another advantage of the present invention is to provide a handheld garment steamer and water tank thereof, wherein the upper portion of the water tank is provided with a design that fits the natural contours of the hand. Particularly, an indented position provides a natural spot for the thumb and index finger to rest, giving the user a precise and controlled grip. This ensures a secure hold, especially when handling the steamer in various angles or positions.

Another advantage of the present invention is to provide a handheld garment steamer and water tank thereof, wherein the indented position and the tapered designs at two sides of the indented position prevents the holding hand of the user from sliding, especially during vertical steaming or when the steamer is used for long periods. This indented area creates a natural stop for the holding hand of the user, preventing it from slipping downward during use, and this enhances the overall grip and stability of the steamer in hand, so as to improve safety and reduce the chance of accidental water spills or burns.

Another advantage of the present invention is to provide a handheld garment steamer and water tank thereof, wherein the design of the indented position of the water tank makes it easier for the user to instinctively know where to place his or her fingers, resulting in quicker and more comfortable handling of the steamer. This leads to a more user-friendly experience, especially for first-time users.

Another advantage of the present invention is to provide a handheld garment steamer and water tank thereof, wherein a separate handle is not required, so that the overall size of the steamer is reduced, making the device more compact and easier to store. This is particularly beneficial for travel, removing the extra handle also decreases the weight of the steamer, making it lighter and more portable.

Another advantage of the present invention is to provide a handheld garment steamer and water tank thereof, wherein the water tank can be mounted to a lateral side of a base housing portion of a main body, so as to allow the water tank to be arranged side-by-side with the base housing portion, so that a height of the water tank is increased, so as to increase the water storing volume of the water tank. The side-by-side configuration optimizes the overall shape of the steamer, allowing the device to maintain a slim profile while still accommodating a larger tank. This helps in preserving portability and storage convenience without sacrificing functionality. Placing the water tank beside the base housing lowers the center of gravity, which can make the steamer more stable in hand. This reduces user strain during extended use and provides better control, especially for vertical steaming.

Another advantage of the present invention is to provide a handheld garment steamer and water tank thereof, wherein despite increasing the water storage volume, the lateral arrangement of the water tank and the base housing portion also allows for a sleeker and more balanced design compared to traditional steamers with bulky tanks placed directly under the base housing.

Another advantage of the present invention is to provide a handheld garment steamer and water tank thereof, wherein the increased water tank height and volume mean the user can steam for longer periods without interruption, improving convenience and efficiency, particularly for larger garments or fabrics that require extended steaming. As in some examples, the water storing volume of the water tank is about 300 ml, so as to allow the steamer to handle up to six garments.

Another advantage of the present invention is to provide a handheld garment steamer and water tank thereof, wherein the ergonomic design can allow for easier one-handed operation, freeing the other hand to adjust garments or perform other tasks while steaming.

Additional advantages and features of the invention will become apparent from the description which follows, and may be realized by means of the instrumentalities and combinations particularly pointing out in the appended claims.

According to the present invention, the foregoing and other objects and advantages are attained by a handheld garment steamer, comprising:

- a housing comprising a base housing portion and a head housing portion transversely connected to the base housing portion;
- a water tank detachably mounted to the base housing portion in a manner that the water tank and the base housing portion form a handle part for a user to hold thereon;
- an evaporation assembly installed in the head housing portion; and
- a water pump assembly for pumping water in the water tank to the evaporation assembly.

According to some embodiments, the water tank is detachably coupled to the base housing portion in a side-to-side manner.

According to some embodiments, the water tank comprises a tank body which comprises an upper portion which is arranged for being gripped by fingers of a holding hand of the user while the base housing portion is arranged for being held in a palm of the holding hand of the user.

According to some embodiments, the water tank comprises a tank body which comprises an upper portion, wherein the upper portion of the tank body has a concave groove for placement of fingers of a holding hand of the user.

According to some embodiments, the water tank comprises a tank body comprising a lower portion, and a seat tank portion extended from the lower portion of the tank body, wherein the water tank is detachably mounted to the base housing portion in a manner that the base housing portion is supported above the seat tank portion at a side of the tank body.

According to some embodiments, the tank body has a first receiving cavity, the seat tank portion has a second receiving cavity, wherein the second receiving cavity is communicated to the first receiving cavity to define a water storing cavity of the water tank.

According to some embodiments, the tank body comprises a bottom wall, a top wall, an enclosing wall, and an attaching wall, wherein the enclosing wall is connected to the attaching wall to form an integral peripheral wall between the bottom wall and the top wall, wherein the base housing portion comprises a bottom engaging wall, an abutting wall connected to the bottom engaging wall and a surrounding wall connected to the abutting wall and the bottom engaging wall, wherein the abutting wall of the base housing portion is attached to the attaching wall of the tank body when the water tank is assembled to the base housing portion, the surrounding wall of the base housing portion and the enclosing wall form an outer peripheral surface of the handle part.

According to some embodiments, the seat tank portion comprises a support part and a base part extended from the support part, wherein the base part comprises a base top wall extended from the attaching wall of the tank body for supporting the bottom engaging wall of the base housing portion, wherein the surrounding wall is supported on the support part when the water tank is assembled to the base housing portion.

According to some embodiments, the base housing portion has a bottom groove under the bottom engaging wall for receiving the base part of the seat tank portion, wherein the seat tank portion has a support notch defined above the support part at a side of the base part, wherein the surrounding wall of the base housing portion comprises a lower wall portion that is fitted to the support notch when the water tank is assembled to the base housing portion.

According to some embodiments, the top wall of the tank body has a refill opening and a connecting hole, wherein the water tank further comprises a sealing element, wherein the sealing element is resilient and comprises a sealing body coupled to the refill opening, and a connecting arm connected to the sealing body and coupled to the connecting hole to allow the sealing body to be pivotally moved to expose the refill opening.

According to some embodiments, the sealing element comprises a ventilation portion integrally extended from the sealing body and has a channel extending in the sealing body and the ventilation portion, wherein the ventilation portion has a slit which is used to communicate the water storing cavity to the channel.

According to some embodiments, the ventilation portion comprises two inclined extending surfaces which are aligned with each other, the slit is defined between bottoms of the two inclined extending surfaces.

According to some embodiments, the tank body comprises an enclosure wall which is vertically extended from the top wall to define an accommodating groove with a side opening, wherein the sealing element is received in the accommodating groove.

According to some embodiments, the water tank comprises a locking unit for detachably coupling the water tank to the base housing portion, wherein the locking unit is hidden between the base part of the seat tank portion and the base housing portion.

According to some embodiments, the locking unit comprises a retention pin extended from the base part, a locking mechanism connected to the base housing portion, wherein the retention pin comprises an inserting head, the locking mechanism comprises two locking members defining a locking cavity with an access opening, and two resilient elements connected to the two locking members respectively, wherein the inserting head of the retention pin is capable of being inserted into the locking cavity through the access opening.

According to some embodiments, the locking unit comprises a mounting pin which is protruded from the base housing portion, and a mounting base formed on the seat tank portion, wherein the seat tank portion has a second receiving cavity, wherein the mounting base is extending into the second receiving cavity and has a mounting hole for engaging with the mounting pin.

According to some embodiments, the water pump assembly comprises a delivery pipe disposed in the water tank, a water valve mounted to the seat tank portion of the water tank, a coupling pipe connected to the base housing portion for detachably coupling with the water valve, a pump element communicated between the coupling pipe and the evaporation assembly.

According to some embodiments, the valve element, which is made of a resilient material and is connected to the delivery pipe, has a valve channel and a slit opening communicated to the valve channel, the slit opening remains naturally closed due to inherent elasticity of the valve element.

According to some embodiments, the vale element comprises two inclined walls which are aligned with each other, and the slit opening is formed between bottoms of the two inclined walls.

According to some embodiments, the seat tank portion has an installing opening, wherein the water valve comprises a valve element and an installing element coupled to the installing opening for mounting the valve element to the delivery pipe, the installing element comprises an installing sleeve and a plurality of biasing walls which are spacedly extended from the installing sleeve for biasing against the delivery pipe, the installing sleeve has a connecting channel which is capable of being communicated to the valve channel.

According to some embodiments, the water valve comprises a valve element which comprises a channel pipe having a receiving channel, a spring disposed in the channel pipe, a pusher member which is biasing against the spring, and a valve sealing ring biasing against the pusher member.

According to some embodiments, the coupling pipe comprises a bottom end portion having one or more slots, the bottom end portion of the coupling pipe pushes the pusher member to move away from the valve sealing ring, so as to allow water in the receiving channel to enter the coupling pipe.

According to some embodiments, the water valve further comprises an installing element which comprises an installing sleeve and a plurality of biasing walls which are spacedly extended from the installing sleeve for biasing against the channel pipe, the installing sleeve has a connecting channel which is capable of being communicated to the receiving channel.

According to some embodiments, the delivery pipe comprises a base pipe portion and a connector pipe portion transversely extended from the base pipe portion, the water valve is mounted to the connector pipe portion, wherein the base pipe portion comprises a tail end portion having a chamfer opening.

According to another aspect, the present invention provides a water tank for handheld garment steamer comprising a housing which comprises a base housing portion and a head housing portion transversely connected to the base housing portion. The water tank is detachably mounted to the base housing portion in a manner that the water tank and the base housing portion form a handle part for a user to hold thereon. The water tank comprises a tank body comprising a lower portion, and a seat tank portion extended from the lower portion of the tank body, wherein the water tank is detachably mounted to the base housing portion in a manner that the base housing portion is supported above the seat tank portion at a side of the tank body.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
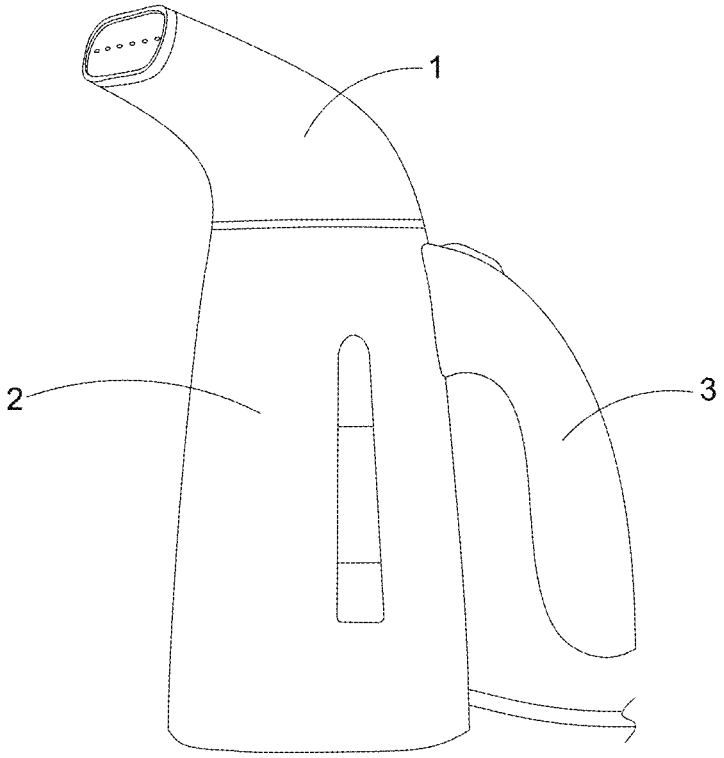
PRIOR ART Fig.1
FIG. 1 is perspective view of a conventional garment steamer.
Figure 2:
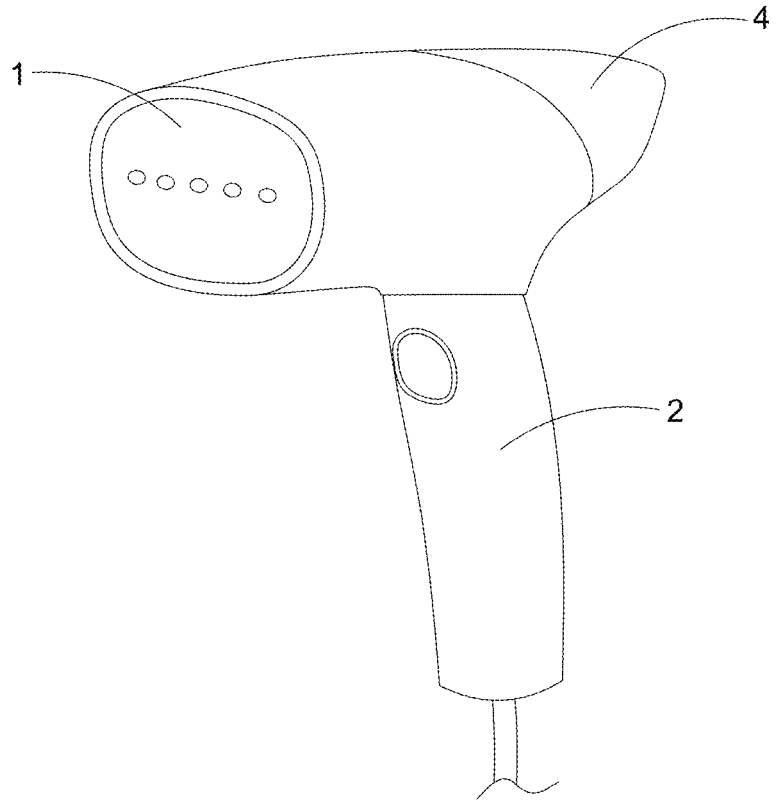
PRIOR ART Fig.2
FIG. 2 is perspective view of another conventional garment steamer.
Figure 3:
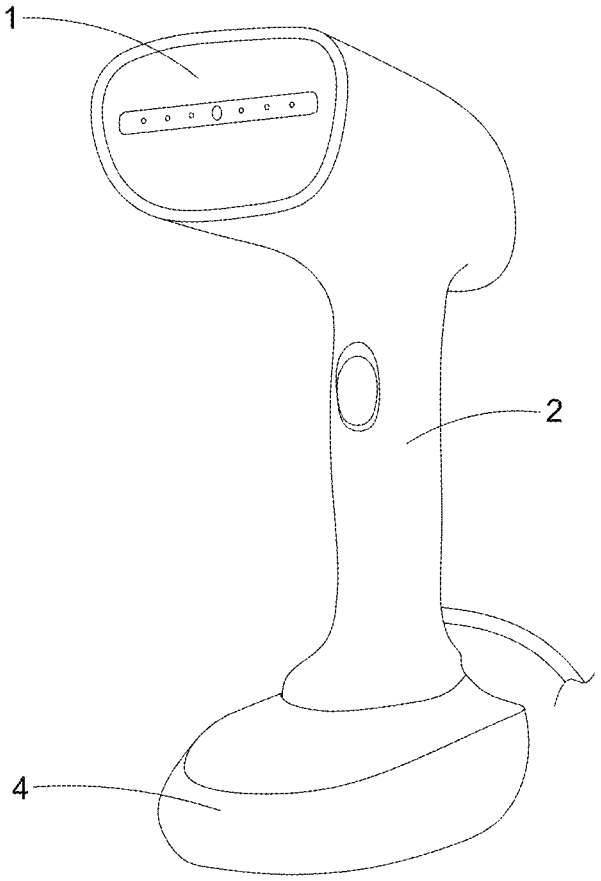
PRIOR ART Fig.3
FIG. 3 is perspective view of another conventional garment steamer.
Figure 4:
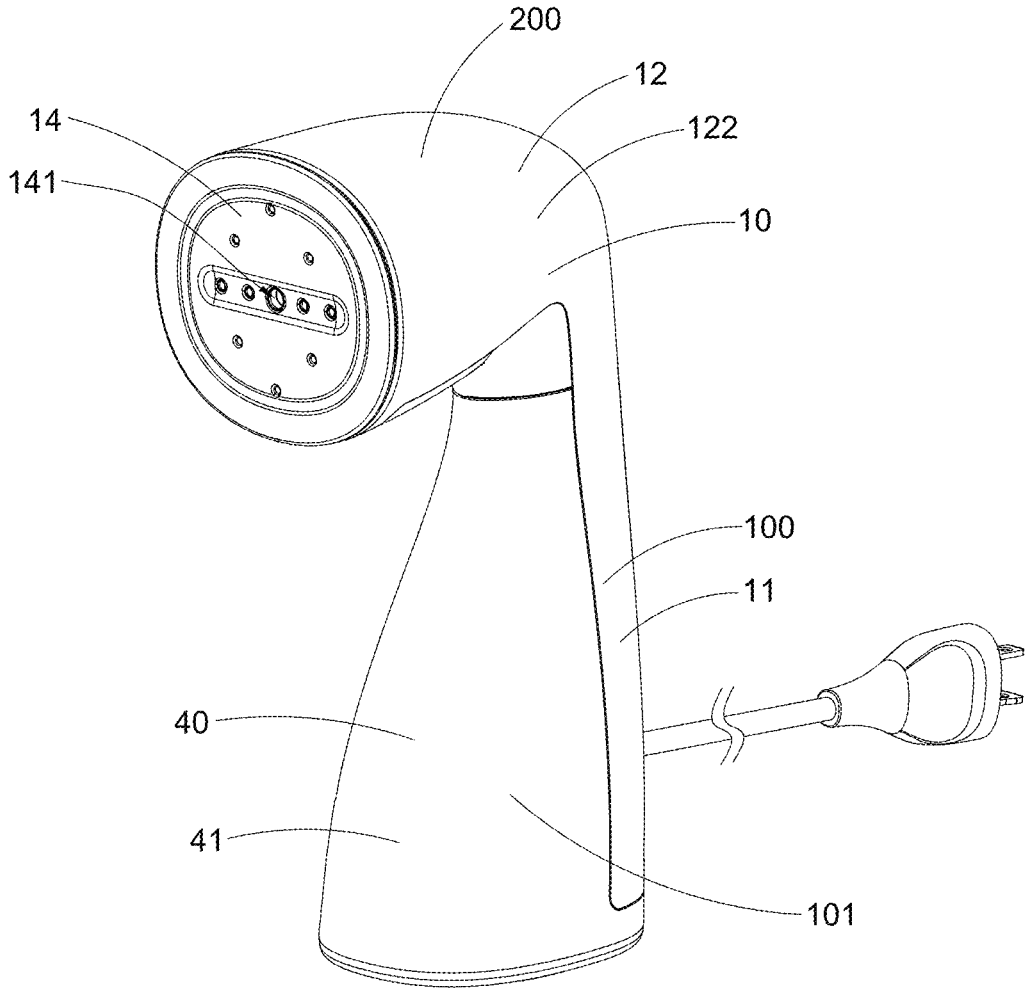
FIG. 4 is perspective view of a handheld garment steamer according a preferred embodiment of the present invention.
Figure 5:
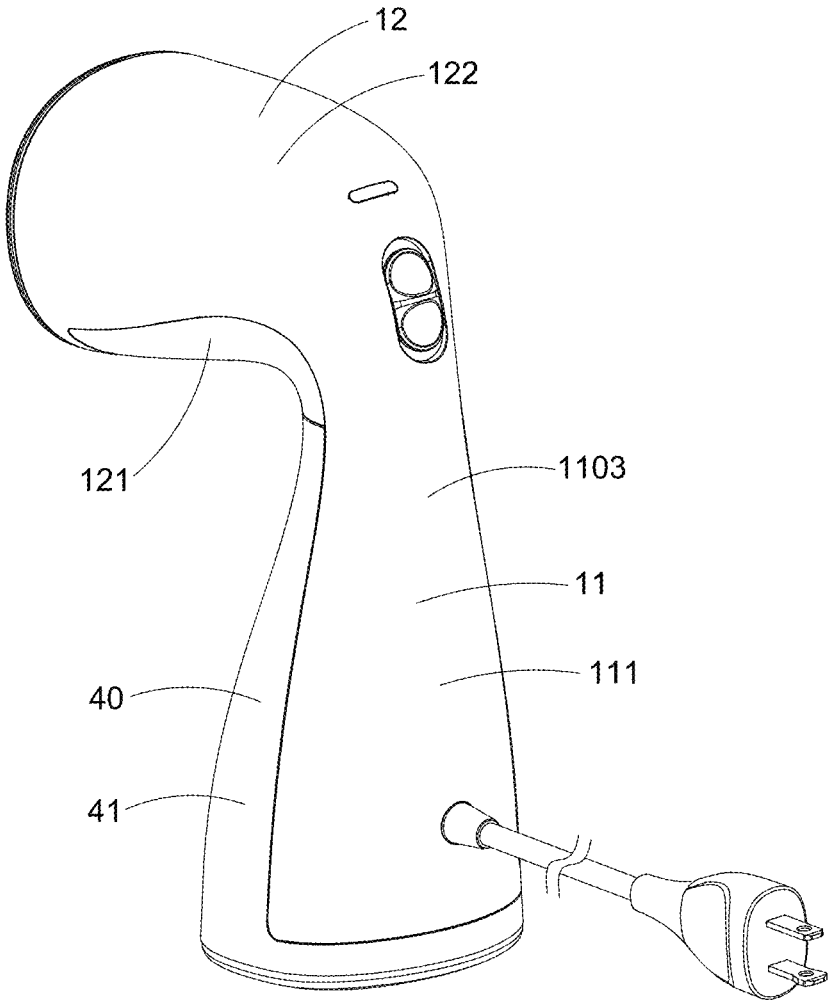
FIG. 5 is another perspective view of the handheld garment steamer according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 4 to FIG. 26 of the drawings, a handheld garment steamer according to a preferred embodiment of the present invention is illustrated. The handheld garment steamer comprises a housing 10, an evaporation assembly 20, a water pump assembly 30 and a water tank 40 detachably coupled to housing 10.

The housing 10, which forms the main body of the handheld garment steamer, encloses and protects the internal components, including the evaporation assembly 20 and the water pump assembly 30. Accordingly, the housing 10 provides durability and protection for the internal components from external damage, heat, and moisture. The housing 10 also can act as an insulating layer to prevent heat transfer to the user's hand, making it safer and more comfortable to handle.

The evaporation assembly 20 is responsible for heating the water supplied from the water tank 40 by the pump assembly 30 and turning it into steam. The evaporation assembly 20 quickly heats water to produce a continuous and powerful flow of steam, which is essential for effective wrinkle removal and garment care.

The water pump assembly 30, which is responsible for transferring water from the water tank 40 to the evaporation assembly 20, ensures a consistent flow of water, enabling continuous steam production. Accordingly, the water pump 30 maintains a steady supply of water to the evaporation assembly 20, ensuring uninterrupted steam output, even during longer use.

The water pump assembly 30 can regulate the water pressure, ensuring that the right amount of water is supplied for optimal steam production, enhancing efficiency and preventing water leakage or overflow. The water pump can ensure precise water delivery, maximizing the efficiency of the handheld garment steamer by using only the necessary amount of water for generating steam.

The water tank 40 is detachable and can be easily removed from the housing 10 for refilling. In this embodiment, the water tank 40 can be securely coupled to the housing 10 and communicated to the water pump assembly 30 when in use, so that when the water pump assembly 30 is in operation, the water pump assembly 30 sucks water in the water tank 40 and feeds the water to evaporation assembly 20 for generating the steam. The water tank 40 is preferred to be made of a transparent material, so as to allow the user to view the water level in the water tank 40.

The detachable feature makes it convenient to refill the water tank 40 without the need to bring the entire handheld garment steamer to the sink, improving ease of use and user experience. The detachable design also allows the user to carry and refill the water tank 40 independently, enhancing portability and flexibility during steaming. The detachable water tank 40 can be easily cleaned and maintained, which is important for preventing mineral buildup and ensuring the longevity of the steamer.

According to this embodiment, as shown in FIGS. 4 to 7 of the drawings, the housing 10 comprises a base housing portion 11 and a head housing portion 12 transversely extended from the base housing portion 11, the water tank 40 is detachably coupled to the base housing portion 11 in a side-by-side manner, so as to form a handle part 100 of the handheld garment steamer of the present invention, the rest part connected to the handle part 100 forms a head part 200.

The base housing portion 11 serves as the foundation of the handheld garment steamer and houses key components such as the water pump assembly 30 and connections to the water tank 40. The base housing portion 11 provides structural support and stability to the handheld garment steamer, the water tank 40 is assembled to the base housing portion 11 to balance the weight of the head part 200 and the handle part 100.

The base housing portion 11 is elongated in shape to allow for effective internal organization of the water pump assembly 30, so as to optimize the functionality of the handheld garment steamer while maintain a compact design. Particularly, in this embodiment, the water tank 40 is also elongated in shape and is positioned alongside the base housing portion 11 when the water tank 40 is assembled to the base housing portion 11. By integrating the water tank 40 in a side-by-side manner, the height of the water thank 40 is increased to increase its water storing volume, the base housing portion 11 also maintains an even weight distribution, improving balance and reducing user fatigue.

The head housing portion 12 is extended transversely from the base housing portion 11 and houses the evaporating assembly 20. Its placement ensures that the steam is emitted at the optimal angle for garment care. Particularly, the transverse extension allows for precise direction of steam, providing better control when targeting specific areas of a garment.

The side-by-side configuration of the water tank 40 with the base housing portion 11 creates a more ergonomic handle part 100. The width and shape of the water tank 40 contribute to a comfortable grip. In addition, the positioning of the water tank 40 allows for increased storage capacity while maintaining a compact design, meaning the user can steam longer without needing to refill.

In this embodiment, the integration of the water tank 40 into the handle part 100 ensures a compact, streamlined design, eliminating the need for a separate bulky handle. This keeps the handheld garment steamer light and easy to maneuver. The design of the water tank 40, coupled with the base housing portion 11, provides a sturdy, well-balanced grip. This is especially important for long steaming sessions or when steaming vertically.

More specifically, the water tank 40 comprises a tank body 41 and a seat tank portion 42 connected to a lower portion 411 of the tank body 41 to define a water storing cavity 43. A length of the tank body 41 is larger than a length of the seat tank portion 42. The base housing portion 11 of the housing 10 is seated and supported on the seat tank portion 42 when the water tank 40 is assembled with the base housing portion 11 of the housing 11. An upper portion 412 of the tank body 41 cooperated with the base housing portion 11 of the housing 10 for a holding hand of the user to hold thereon.

The tank body 41 forms the main component of the water tank 40 and serves as the primary water storage area by defining an elongated first receiving cavity 431. The seat tank portion 42 has a second receiving cavity 432, the first receiving cavity 431 is communicated to the second receiving cavity 432 to from the water storing cavity 43.

Since the tank body 41 is elongated in shape and has a relatively large height, the first receiving cavity 431 also is elongated in shape, so as to maximize the water capacity of the water tank 40 without increasing the bulkiness of the handheld garment steamer. In this embodiment, the water level in the first receiving cavity 431 is relatively high that it is adjacent to a bottom of the head housing portion 12.

The elongated shape of the first receiving cavity 431 optimizes the available space, increasing water storage without enlarging the overall size of the steamer. This feature extends the operational time between refills, making the steamer more convenient for prolonged use. As a particularly example, the combined water capacity of the first receiving cavity 431 and the second receiving cavity 432 can be about 300 ml which can handle up to six garments in a single refill.

Accordingly, with a 300 ml water capacity, the handheld garment steamer can process multiple garments in one go, reducing the need for frequent refills. This is especially convenient for the user handling larger batches of clothing, improving overall efficiency. The larger capacity minimizes interruptions during steaming, saving time and effort. This is particularly beneficial for the user who need to steam multiple garments consecutively, such as in professional or household settings. A 300 ml capacity strikes a balance between sufficient water volume and maintaining the handheld convenience. The user gets more steaming done without compromising the lightweight, portable nature of the handheld garment steamer.

According to this embodiment, the seat tank portion 42 is integrally extended from the lower portion 411 of the tank body 41 and is designed to support the base housing portion 11 which is adapted for being mounted on the top of the seat tank portion 42. Accordingly, when the water tank 40 is assembled with the base housing portion 11, the seat tank portion 42 acts as a foundation or seat for the housing 10, stabilizing the overall structure.

Figure 6:
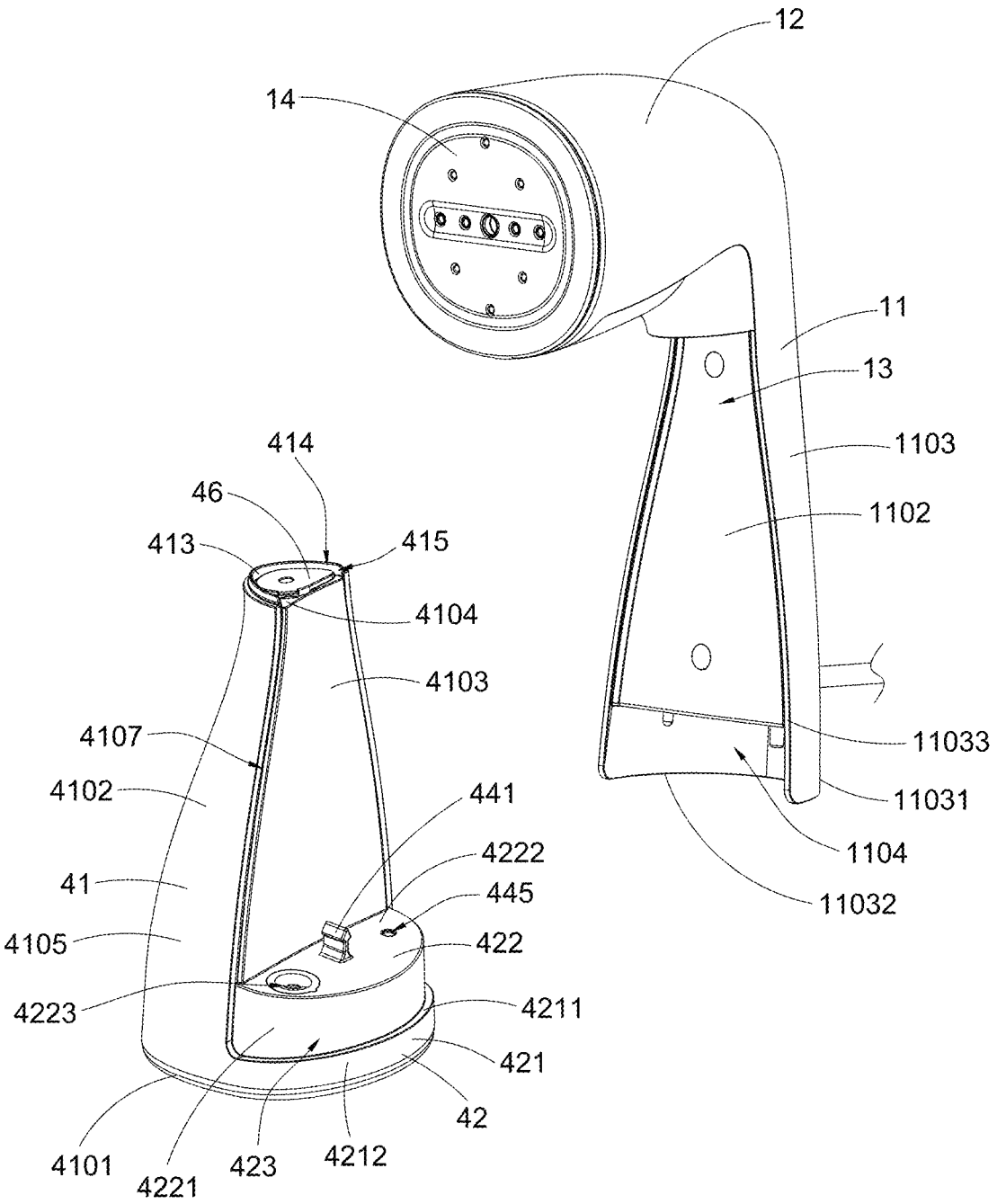
FIG. 6 is an exploded view of the handheld garment steamer according to the above preferred embodiment of the present invention.
Figure 8:
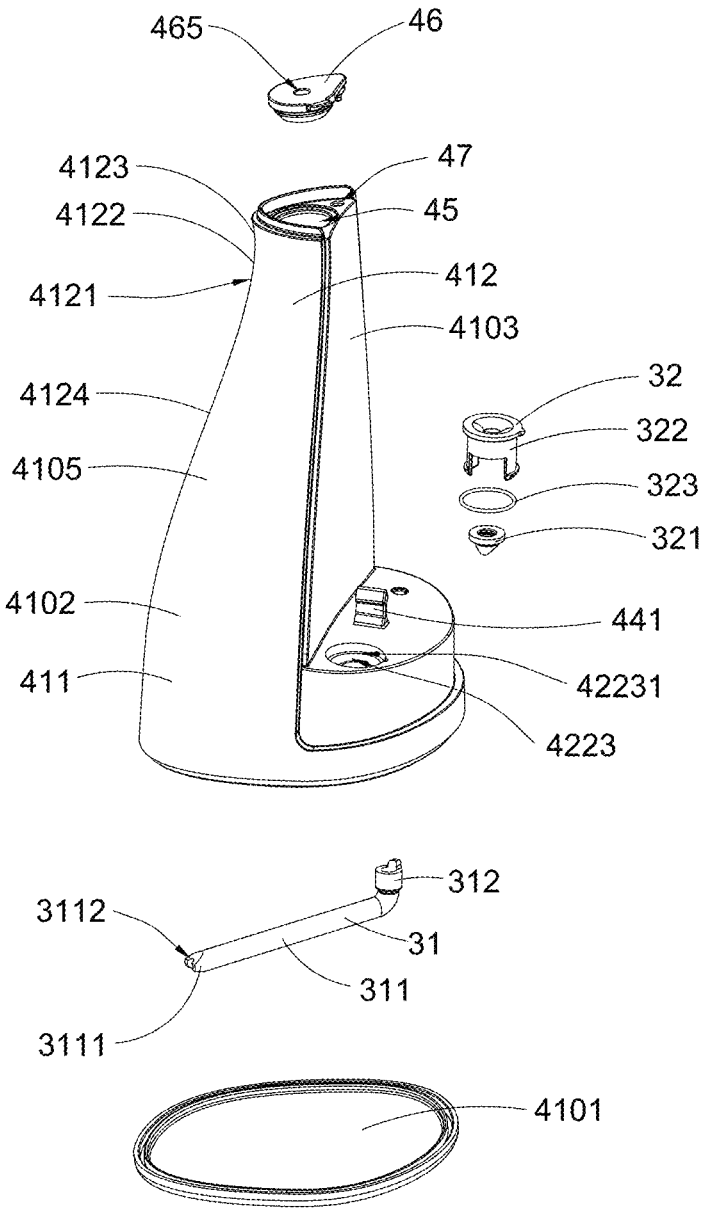
FIG. 8 is a further exploded view of a water tank of the handheld garment steamer according to the above preferred embodiment of the present invention.

More specifically, as shown in FIG. 6 and FIG. 8, the tank body 41 comprises a bottom wall 4101, an enclosing wall 4102, an attaching wall 4103, and a top wall 4104. The enclosing wall 4102 is connected to the attaching wall 4103 to form an integral peripheral wall 4105 between the bottom wall 4101 and the top wall 4104, the first receiving cavity 431 is defined by the integral peripheral wall 4105, the bottom wall 4101 and the top wall 4104.

The attaching wall 4103 has a length that is smaller that a length of the enclosing wall 4102, a communicating opening 4106 is formed below the attaching wall 4103 for communicating the second receiving cavity 432 to the first receiving cavity 431 to form the water storing cavity 43.

In this embodiment, the base housing portion 11 is abutting against the attaching wall 4103 when the base housing portion 11 is assembled with the water tank 40. Accordingly, the attaching wall 4103 and the seat tank portion 42 can be arranged to securely support the base housing portion 11. The combination of the attaching wall 4103 and seat tank portion 42 forms the foundational support structure for the base housing portion 11.

The base housing portion 11 can be aligned to press against the attaching wall 4103, creating a close contact between the water tank 40 and the base housing portion 11. The abutment between the base housing portion 11 and the attaching wall 4103 provides stability, preventing unnecessary movement or detachment during operation. The seat tank portion 42 provides a stable foundation for the base housing portion 11 to rest on, improving the overall structural integrity of the handheld garment steamer. This design ensures that the handheld garment steamer remains securely connected and can be handled with confidence. The secure fit between the base housing portion 11 and the water tank 40 ensures that the water tank 40 can withstand the weight and movements associated with regular use, increasing the durability of the handheld garment steamer.

As shown in FIG. 6 of the drawings, the attaching wall 4103 can be a substantial flat wall which is arranged in a vertical direction. A plane of the attaching wall 4103 can be flat straight or is slightly arched with a slight curvature. The base housing portion 11 comprises a base housing body 111 which comprises a bottom engaging wall 1101, an abutting wall 1102 and a surrounding wall 1103, the abutting wall 1102 is connected to the surrounding wall 1103 to form an integral peripheral housing wall of the base housing body 111, both of the abutting wall 1102 and the surrounding wall 1103 are connected to the bottom engaging wall 1101 to define a base housing cavity 112 of the base housing body 111. When the water tank 40 is assembled with the base housing portion 11, the abutting wall 1102 is abutting against the attaching wall 4103 of the water tank 4103, the bottom engaging wall 1101 is seated on the seat tank portion 42. The surrounding wall 1103 of the base housing portion and the enclosing wall 4102 form an outer peripheral surface 101 of the handle part 100.

Accordingly, the attaching wall 4103 is vertically oriented and can be either flat or slightly curved, providing a large surface for secure connection. The large surface area of the attaching wall 4103 allows for firm contact with the abutting wall 1102, enhancing the structural integrity of the connection between the water tank 40 and the base housing portion 11.

The abutting wall 1102 directly contacts the attaching wall 4103, ensuring that the base housing portion 11 is securely abutting against the water tank 40. The direct contact between the abutting wall 1102 and the attaching wall 4103 ensures a firm and stable connection, preventing wobbling or detachment during operation.

In this embodiment, the attaching wall 4103 is protruded from two edges 41020 of the enclosing wall 4102, so that two notches 4107 are respectively formed at two opposite sides of the attaching wall 4103. The seat tank portion 42 comprises a support part 421 and a base part 422 which is protruded from the support part 421, the support part 421 comprises a top edge 4211 which forms a curved step for supporting the base housing portion 11. The two edges 41020 of the enclosing wall 4102 are respectively integrally and smoothly extended from the two sides of the top edge 4211 of the support art 421, so as to form an integral step for supporting the base housing portion 11.

Figure 7:
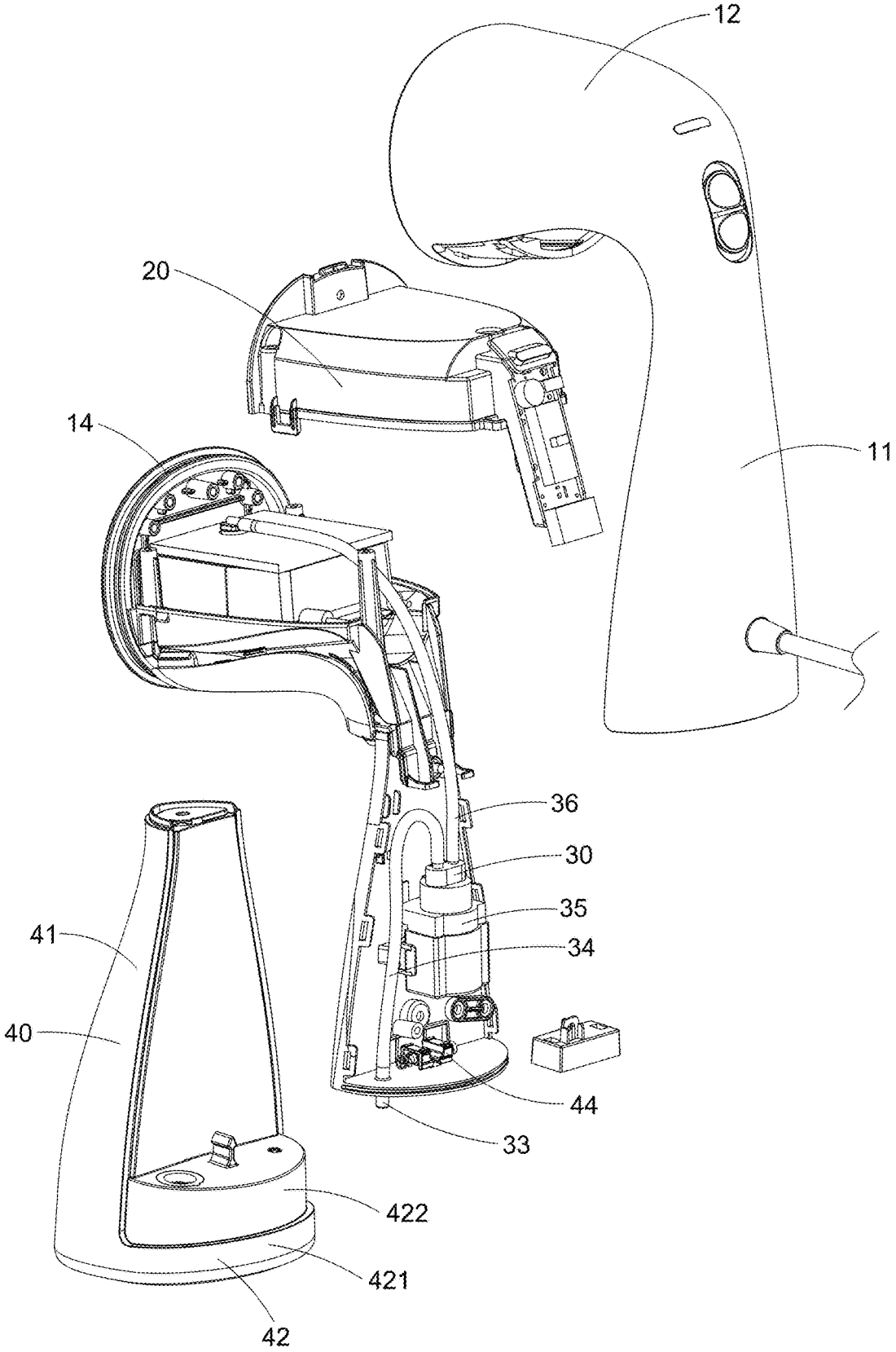
FIG. 7 is a further exploded view of the handheld garment steamer according to the above preferred embodiment of the present invention.

As shown in FIGS. 7 and 8 of the drawings, the support part 421 shares a same bottom wall 4101 of the tank body 41 and comprises a side wall 4212 which is connected to the bottom wall 4101 and the enclosing wall 4102 of the tank body 41, a support notch 423 is formed above the top edge 4211 of the support part 421 and an outer side of the base part 422. The base part 422 comprises a base side wall 4221 connected to the top edge 4211 of the support part 421 and the enclosing wall 4102 of the tank body 41, and a base top wall 4222 connected to the attaching wall 4103 of the tank body 41 and the base side wall 4221.

Figure 9:
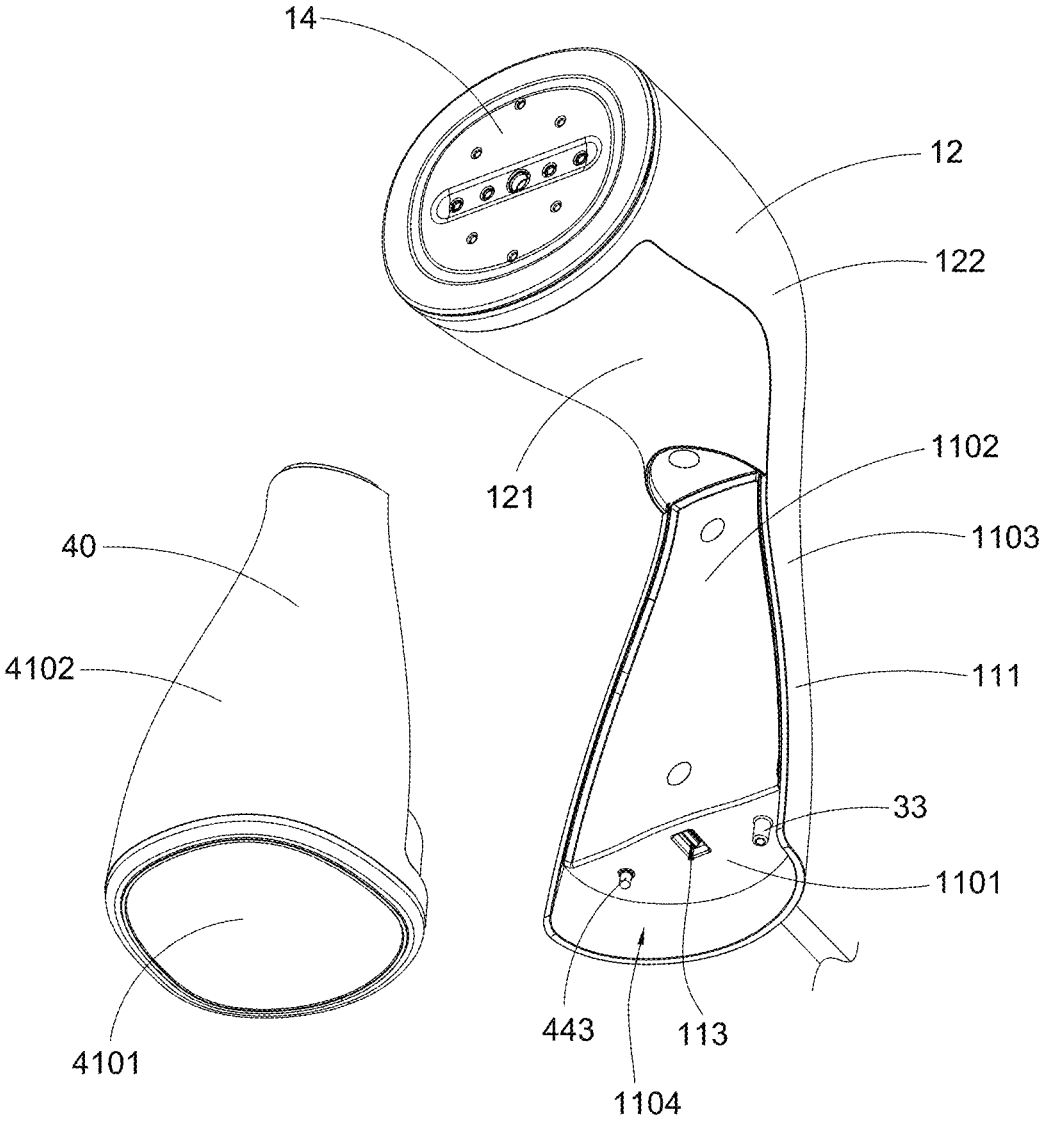
FIG. 9 is another exploded view of the handheld garment steamer according to the above preferred embodiment of the present invention.
Figure 10:
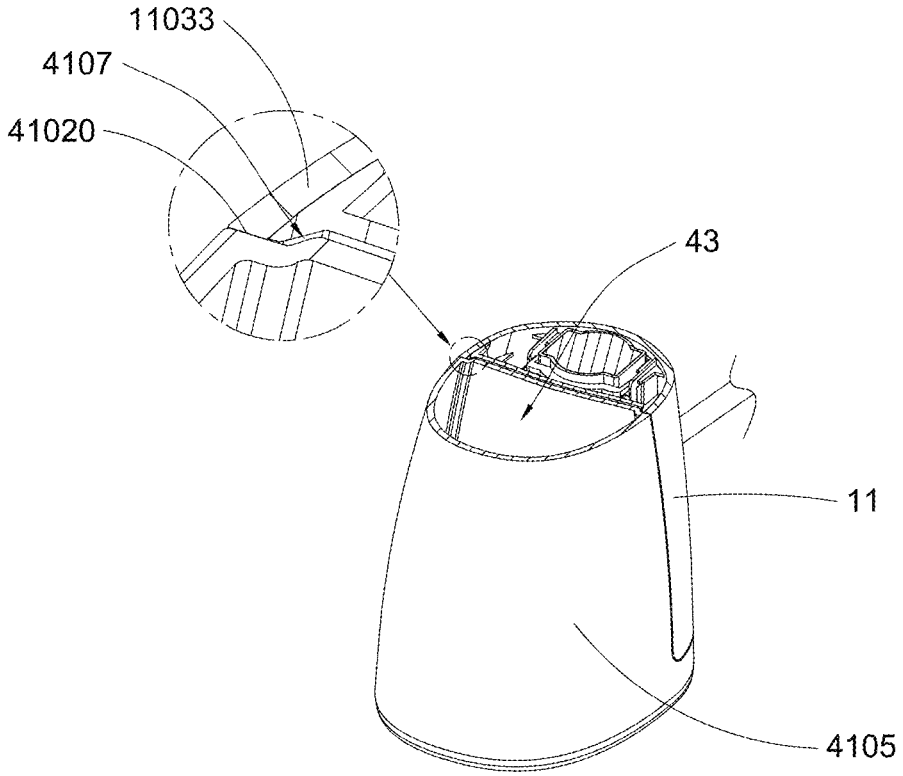
FIG. 10 is a schematic view illustrating the engagement between the water tank and the base housing portion of the handheld garment steamer according to the above preferred embodiment of the present invention.

As shown in FIG. 9, the base housing portion 11 has a bottom groove 1104 formed below the bottom engaging wall 1101 at a position corresponding to the base part 422 of the seat tank portion 42. The surrounding wall 1103 comprises a lower wall portion 11031 having a bottom edge 11032, the bottom groove 1104 is defined between the bottom engaging wall 1101 and the lower wall portion 11031 of the surrounding wall 1103 of the base housing portion 11. Accordingly, the bottom engaging wall 1101 is indented in comparison with the bottom edge 11032 of the surrounding wall 1103, a height of the abutting wall 1102 is shorted than a height of the surrounding wall 1103, so that the bottom groove 1104 is formed under the bottom engaging wall 1101. The bottom edge 11032 of the surrounding wall 1103 is adapted for being seated on the top edge 4211 of the support part 421 of the seat tank portion 42. The surrounding wall 1103 comprises two side edges 11033 which are respectively protruded from the abutting wall 1102 and are adapted for abutting against the two edges 41020 of the enclosing wall 4102 of the tank body 41.

With reference to FIGS. 6 to 10 of the drawings, when the base housing portion 11 of the housing 11 is assembled with the water tank 40, the top edge 4211 of the support part 421 of the seat tank portion 42 supports the bottom edge 1102 of the surrounding wall 1103 of the base housing portion 11, the lower wall portion 11031 of the surrounding wall 1103 of the base housing portion 11 is received in the support notch 423 above the top edge 4211 of the support part 421 of the seat tank portion 42 and abutting against the curved base side wall 4221 of the base part 421, the base part 421 is received in the bottom groove 1104 of the base housing portion 11, the bottom engaging wall 1101 of the base housing portion 11 is seated on the base top wall 4222 of the base part 422, the abutting wall 1102 of the base housing portion 11 is abutting against the attaching wall 4103 of the tank body 41, the two side edges 11033 of the surrounding wall 1103 are respectively extended into the two notches 4107 and are abutting against the two edges 41020 of the enclosing wall 4102 of the tank body 41, so that the enclosing wall 4102 of the tank body 41, the side wall 4212 of the support part 421 of the seat tank portion, and the surrounding wall 1103 of the base housing portion 11 are coupled with each other to form an integral smooth peripheral wall of the handle part 100 of the handheld garment steamer.

According to this embodiment, the attaching wall 4103 protrudes from the enclosing wall 4102, forming two notches 4107 on opposite sides. These notches 4107 provide clearance for the side edges 11033 of the surrounding wall 1103 of the base housing portion 11, enabling the surrounding wall 1103 to fit seamlessly with the water tank 40. The notches 4107 allow the side edges 11033 of the surrounding wall 1103 of the base housing portion 11 to securely abut against the enclosing wall 4102, creating a tight, stable connection that minimizes any movement between the water tank 40 and the base housing portion 11 during operation.

The support part 421 extends from the bottom of the tank body 41 and has the top edge 4211 that forms a curved step to support the base housing portion 11. The base part 422 is connected to the support part 421 and forms a base side wall 4221 and base top wall 4222 that serve as additional support for the base housing portion 11. The top edge 4211 of the support part 421 serves as the main seating area for the surrounding wall 1103, ensuring that the base housing portion 11 is well-supported when assembled with the water tank 40. This improves the overall balance of the handheld garment steamer.

The bottom groove 1104 allows the base part 422 to lock into place, ensuring that the base housing portion 11 remains firmly attached to the water tank. This arrangement prevents any wobbling or detachment during use.

The seamless connection between the surrounding wall 1103, the enclosing wall 4102, and the support part 421 creates a unified, smooth peripheral surface for the handle part 100. This design enhances user comfort by providing a streamlined handle that feels natural to grip. Actually, the smooth integration of these walls creates a comfortable, continuous surface for the user to grip, enhancing the overall ergonomics of the steamer.

The groove and step design also contribute to a compact form factor, which helps to keep the handheld garment steamer be lightweight and easy to maneuver without sacrificing water capacity or performance. The tight coupling between these components ensures that the handle is robust and capable of withstanding the stress of regular use without degrading the connection between the housing 10 and the water tank 40.

Figure 24:
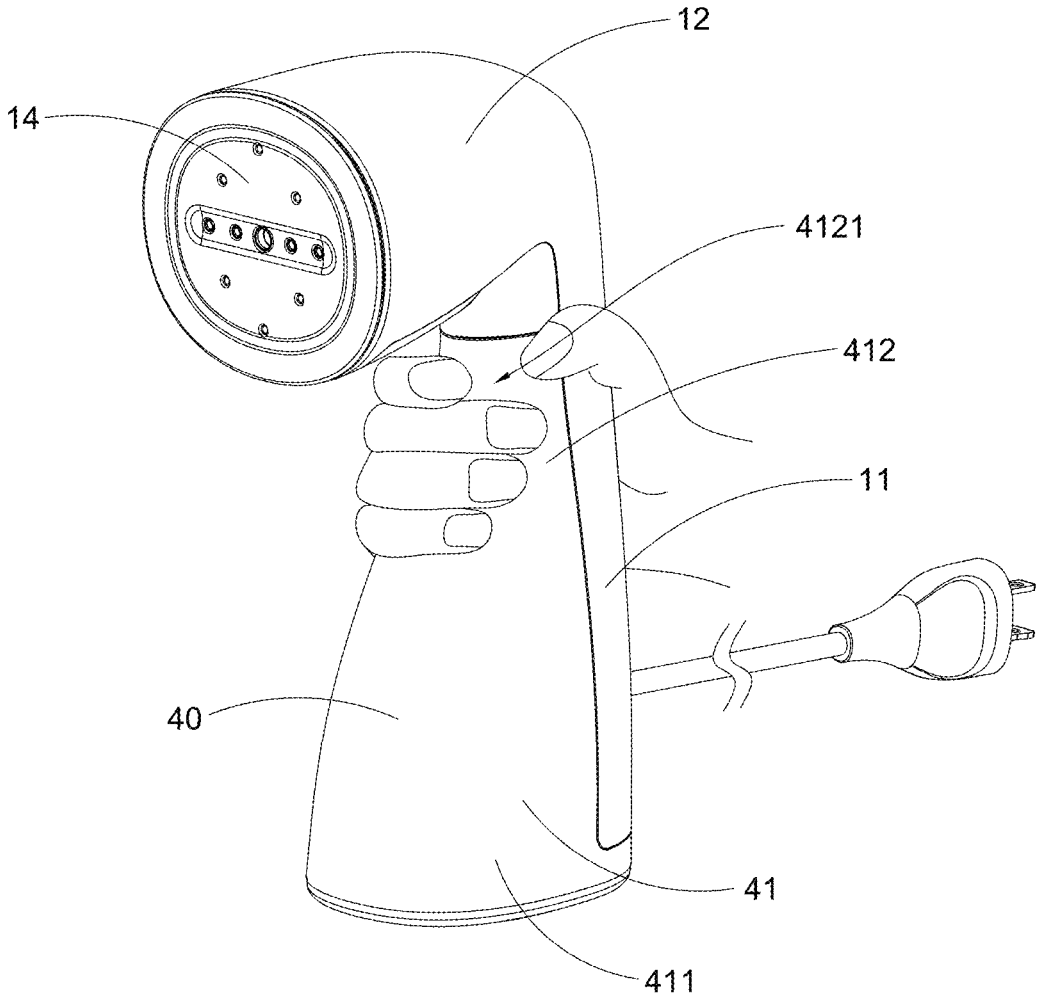
FIG. 24 is a perspective view illustrating the handheld garment steamer being held in a holding hand of a user according to the above preferred embodiment of the present invention.

As shown in FIG. 24 of the drawings, in this embodiment, the base housing portion 11 can be detachably assembled to a rear side of the water tank 40, and when the holding hand of the user is holding on the handle part 100 formed by the water tank 40 and the base housing portion 11, a palm of the holding hand is mostly pressing on the surrounding wall 1103 of the base housing portion 11 while fingers of the holding hand are mostly pressing on the enclosing wall 4102 of the tank body 41 of the water tank 40.

Accordingly, the palm of the holding hand primarily presses against the surrounding wall 1103 of the base housing portion 11. This surrounding wall 1103 forms the rear side of the handle part 100, providing a stable and secure surface for the palm of the user. The fingers of the holding hand naturally wrap around and press against the enclosing wall 4102 of the tank body 41. This enclosing wall 4102 forms the front portion of the handle part 100, allowing the fingers to grip it comfortably. The seamless integration of the water tank 40 and the base housing portion 11 ensures that the handle part 100 is well-balanced, allowing for a natural and secure grip during operation, so as to optimize user comfort.

In addition, this configuration distributes the weight of the handheld garment steamer more evenly between the water tank 40 and the base housing portion 11. This balance reduces strain on the wrist and allows for more precise maneuvering while steaming garments. The design ensures that the palm of the holding hand is pressing on the surrounding wall 1103 of the base housing portion 11 while the fingers grasp the enclosing wall 4102 of the water tank 40, this ergonomic grip makes the device feel more natural in hand and enhances control during use.

Figure 25:
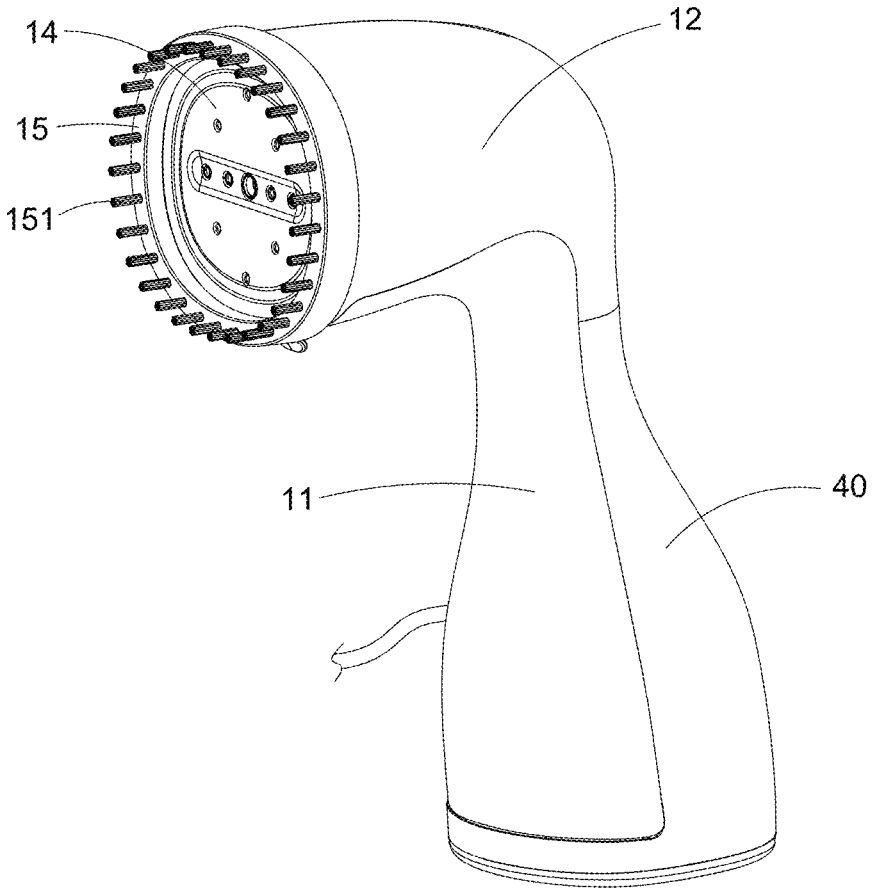
FIG. 25 is a perspective view of an alternative handheld garment steamer according to the above preferred embodiment of the present invention.
Figure 26:
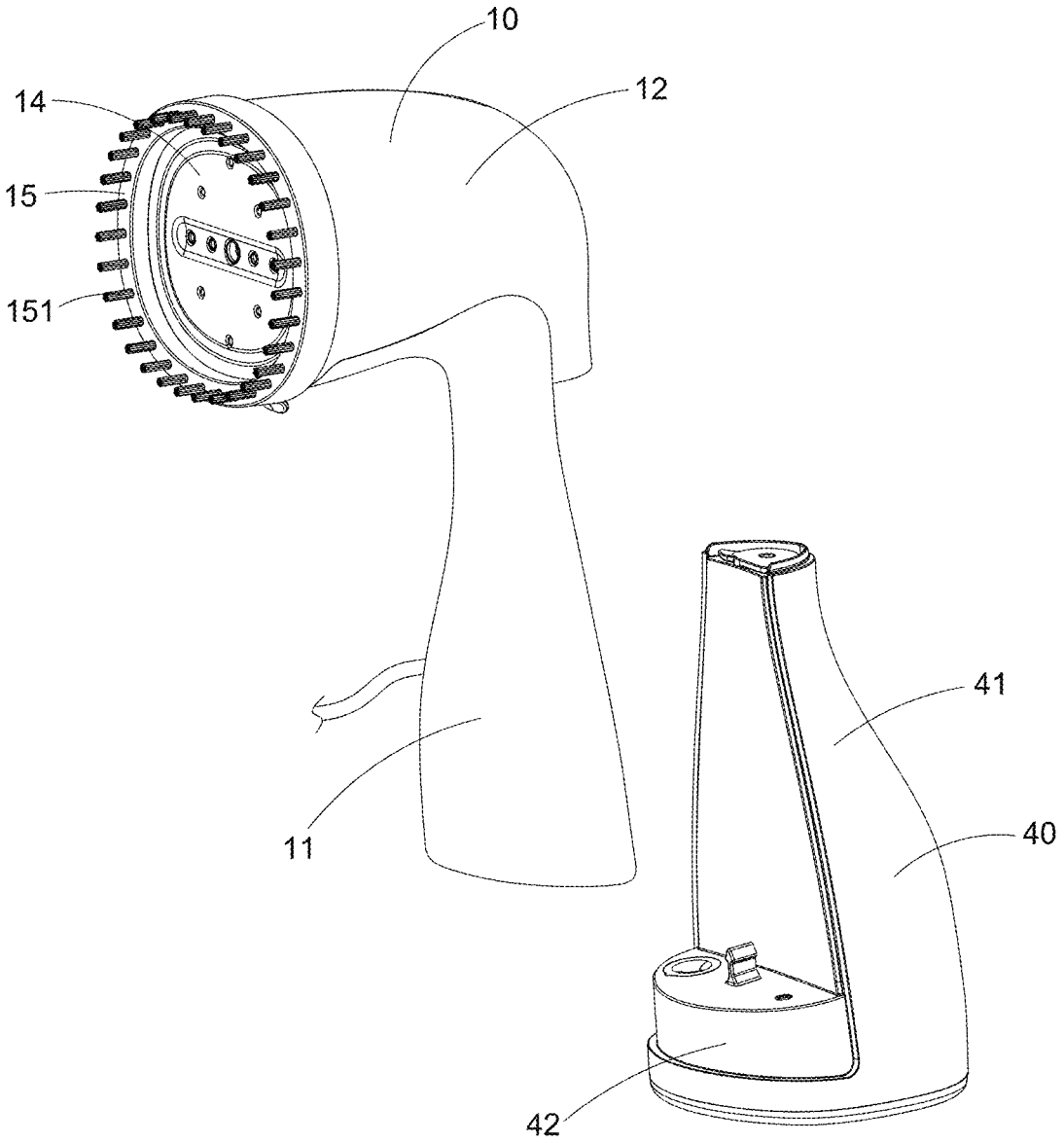
FIG. 26 is an exploded view illustrating the alternative handheld garment steamer according to the above preferred embodiment of the present invention.

Alternatively, as shown in FIGS. 25 and 26, the base housing portion 11 may be detachably assembled at a front side of the water tank 40. This configuration integrates the water tank 40 and base housing portion 11 into a single unit with a smooth profile, contributing to both a sleek design and ease of assembly/disassembly for refilling or cleaning.

The housing 10 has a side groove 13 formed at an inner side of the base housing portion 11 below the head housing portion 12, so that the tank body 41 of the water tank 40 can be fitted to the side groove 13 when the water tank 40 is assembled with the base housing portion 11 of the housing 10.

According to this embodiment, the enclosing wall 4102 of the tank body 41 of the water tank 40 has a curved profile for conforming to the holding hand of the user. More specifically, the enclosing wall 4102 of the upper portion 412 of the tank body 41 has a concave groove 4121 for placing the fingers of the holding hand of the user. The upper portion 412 of the tank body 41 comprises a first curved wall 4123 extended outward and upward from a base position 4122 and a second curved wall 4124 extended outward and downward from the base position 4122. The base position 4122 is the lowest indented point under the concave groove 4121, the surface curves outward from the base position 4122 in both directions.

The curved walls 4123 and 4124, particularly with the concave groove 4121, allow for more precise control over the angle and direction of the handheld garment steamer. This is especially useful when dealing with delicate fabrics or when applying steam to hard-to-reach areas like cuffs or collars. The combination of the concave groove 4121 and the outward-curved surfaces provides friction points for the fingers, reducing the likelihood of the handheld garment steamer slipping from the user's grip, especially during vertical steaming or when the steamer is used for long periods.

In addition, the curved and concave design not only serves an ergonomic purpose but also contributes to the overall aesthetic appeal of the handheld garment steamer. The smooth transitions between the curved walls 4123 and 4124 and the concave groove 4121 make the handheld garment steamer visually pleasing while maintaining functionality.

As shown in FIG. 7 and FIG. 24 of the drawings, the indented base position 4122 provides a natural spot for the thumb and index finger to rest, the rest fingers can be naturally placed on the second curved wall 4124, giving the user a precise and controlled grip, so as to ensure a secure hold, especially when handling the steamer in various angles or positions. This indented area with the concave groove 4121 creates a natural stop for the holding hand of the user, preventing it from slipping downward during use, and this enhances the overall grip and stability of the handheld garment steamer in hand, so as to improve safety and reduce the chance of accidental water spills or burns. The design of the indented base position 4122 of the water tank 40 also makes it easier for the user to instinctively know where to place his or her fingers, resulting in quicker and more comfortable handling of the handheld garment steamer.

According to this embodiment, the water tank 40 and the base housing portion 11 are detachably assembled with each other by a locking unit 44. The locking unit 44 is hidden between the seat tank portion 42 of the water tank 40 and the base housing portion 11, so as to ensure the aesthetic appearance of the outer surface of the handle part 100, and prevent the unwanted touch of the user on the locking unit 44.

The locking unit 44, which can be any suitable detachable assembling means, may comprise magnetically attracting fasteners, snap fasteners, hook-and-eye fasteners, clip fasteners, buckle fasteners or screw fasteners.

Figure 15A:
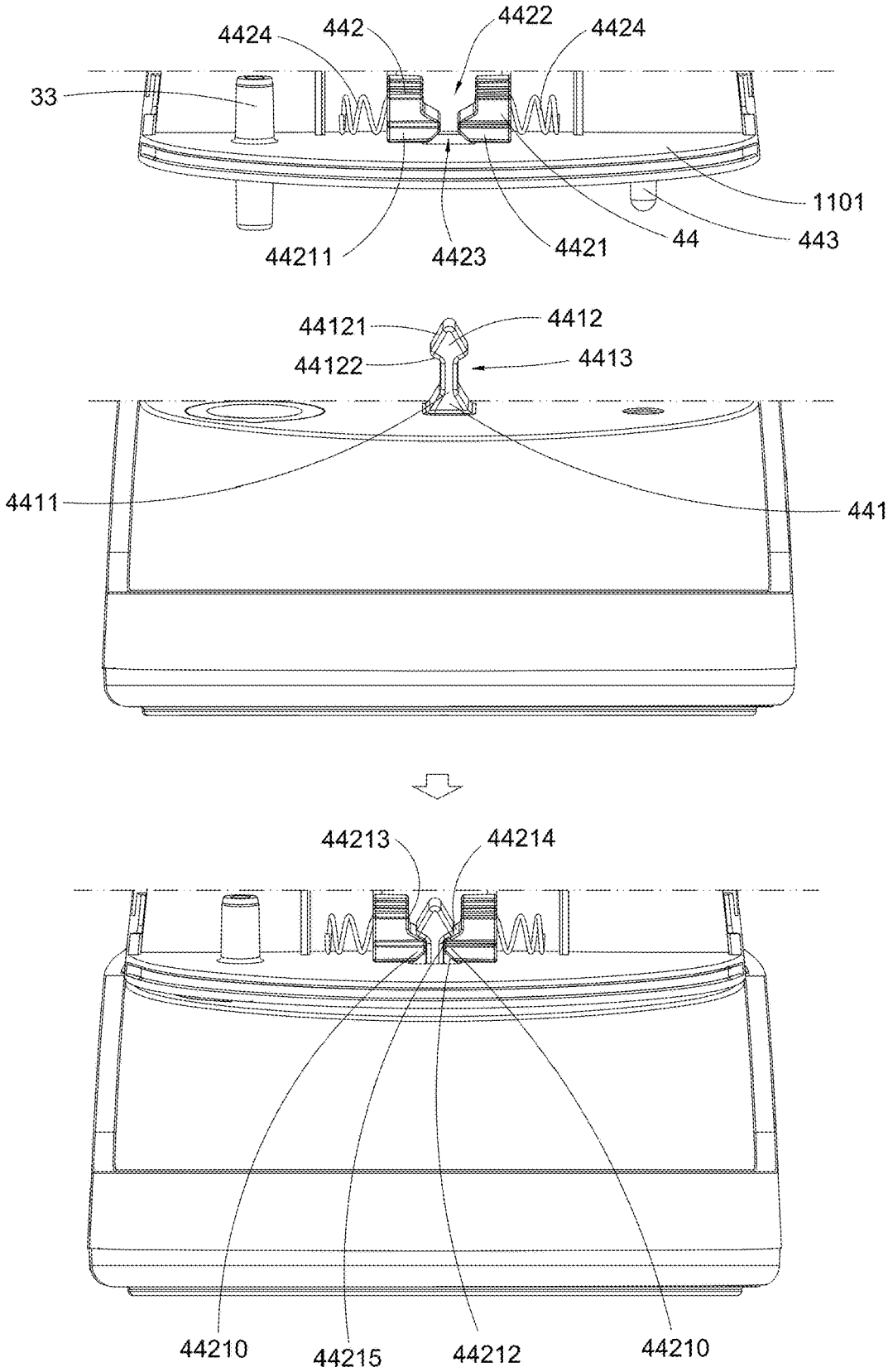
FIG. 15A is a schematic view illustrating the engagement between a retention pin and a locking mechanism of the handheld garment steamer according to the above preferred embodiment of the present invention.

As shown in FIG. 15A of the drawings, the locking unit 44 comprises a retention pin 441 which is protruded from the base top wall 4222 of the base part 422 of the seat tank portion 42 and a locking mechanism 442 mounted to the base housing portion 11 to retain the retention pin 441 in position when the water tank 40 is assembled with the base housing portion 11.

More specifically, the retention pin 441 comprises a pin body 4411 and an inserting head 4412 which is connected to the pin body 4411, an indented groove 4413 is formed around the pin body 4411 below the inserting head 4412.

The base housing body 111 has an assembling hole 113 formed in the bottom engaging wall 1101 for allowing the inserting head 4412 of the retention pin 441 to pass therethrough. The locking mechanism 442 comprises a locking element 4421 defining a locking cavity 4422 with an access opening 4423, and at least one resilient element 4424 connected to the locking element 4421.

Referring to FIG. 15A of the drawings, the inserting head 4412 of the retention pin 441 can be inserted into the locking cavity 4422 through the access opening 4423, so as to be retained in the locking cavity 4422 because of the resilient force of the resilient element 4424 applied to the locking element 4421.

The locking element 4421 comprises two locking members 44211, and two resilient elements 4424 respectively connected to the two locking members 44211, the locking cavity 4422 is defined between the two locking members 44211. When the inserting head 4412 of the retention pin 441 is inserted into the locking cavity 4422, each of the two resilient element 4424, which can be embodied as a spring, can be compressed, so that the compressed two resilient elements 4424 will securely retain the inserting head 4412 within the locking cavity 4422. A first end of each resilient element 4424 is connected to the corresponding locking member 44211, an opposite second end of each resilient element 4424 can be fixed to a wall of the base housing portion 11.

Each of the two locking members 44211 has a lower inclined guiding surface 44212 and an upper retention surface 44213, the access opening 4423 is defined between the two lower inclined guiding surfaces 44212 and is having gradually width from bottom to top, the locking cavity 4422 is defined between the two upper retention surfaces 44213. The inserting head 4412 comprises two inclined engaging surfaces 44121 each has a diamond shape.

When the water tank 40 is assembled with the base housing portion 11, the inclined engaging surfaces 44121 of the inserting head 4412 of the retention pin 441 are respectively sliding along the two lower inclined guiding surfaces 44212 of the two locking members 44211, so as to force the two locking members 44211 to move apart from each other, so that the inserting head 4412 can be moved into the locking cavity 4422, the two locking members 44211 at two opposite sides of the locking element 4421 will be compressed to allow the two upper retention surface 44213 to biasing against the inserting head 4412, so as to firmly retain the inserting head 4412 in the locking cavity 4422.

Each of the upper retention surface 44213 has a curved surface, and a lower portion of the upper retention surface 44213 is biasing against a lower surface of the inserting head 4412, so as to prevent the inserting head 4412 to escape from the locking cavity 4422.

According to this embodiment, the two resilient elements 4424 are compressed during insertion, allowing them to firmly hold the inserting head 4412 once it is inside the locking cavity 4422. This provides a reliable and secure connection between the water tank 40 and the base housing portion 11.

Each locking member 44211 has the lower inclined guiding surface 44212 that guides the insertion of the retention pin 441. The upper retention surface 44213 holds the inserting head 4412 in place. The gradual widening of the access opening 4423 from bottom to top makes insertion easier while still ensuring a snug fit once fully inserted. The diamond-shaped inclined engaging surfaces 44121 on the inserting head 4412 help guide the inserting head 4412 of the retention pin 441 into the locking cavity 4422, allowing it to smoothly slide along the inclined guiding surfaces 44212.

Once the inserting head 4412 is inside the locking cavity 4422, the upper retention surfaces 44213 press against the inserting head 4412, ensuring it remains securely locked in place. The biasing of the curved upper retention surfaces 44213 against the lower part of the inserting head 4412 prevents any accidental disengagement. The curved design of the upper retention surface 44213 provides additional security. It ensures that the inserting head 4412 is not only firmly held but also prevents any unintentional upward movement, which could cause the inserting head 4412 retention pin to escape from the locking cavity 4422.

The locking unit 44 ensures that the water tank 40 and the base housing portion 11 are tightly connected, reducing the risk of separation during operation. This is especially important for the handheld garment steamer, where stability and secure assembly are critical for safe use.

In this embodiment, each locking member 44211 comprises a protrusion 44210 which has the lower inclined guiding surface 44212, an upper curved abutting surface 44214 for abutting a lower surface 44122 of the inserting head 4412 and a biasing surface 44215 for extending into the indented groove 4413 to bias against an outer surface of the pin body 4411. By engaging with the indented groove 4413, the biasing surface 44215 prevents any displacement of the pin body 4411, further ensuring that the water tank 40 and base housing portion 11 remain securely connected during operation.

While the mechanism securely holds the water tank 40 to the base housing portion 11, it is designed to be easily detachable when needed. The resilience of the springs allows for quick and hassle-free disassembly. More specifically, when the user apply a force of the water tank 40 or the base housing portion 11, the inserting head 4412 is moved downward with respect to the base housing portion 11, so that the downward moving inserting head 4412 will force the resilient elements 4424 to be further compressed, so as to allow the two locking members 44211 to move apart, so that the inserting head 4412 can be moved out from the locking cavity 4422. Once the inserting head 4412 is detached from the locking cavity 4422 and the access opening 4423, the restoring of the two resilient elements 4424 will restore the original positions of the two locking members 44211.

Figure 16:
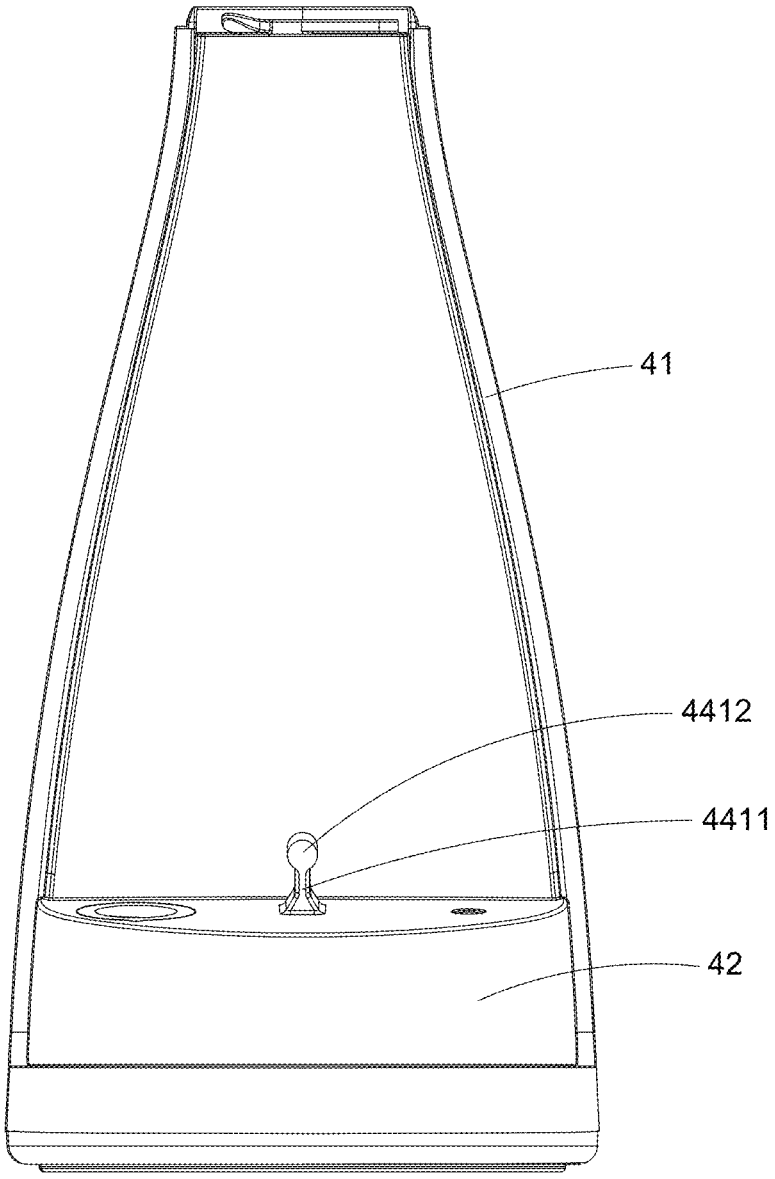
FIG. 16 is a schematic view illustrating an alternative retention pin of the handheld garment steamer according to the above preferred embodiment of the present invention.
Figure 17:
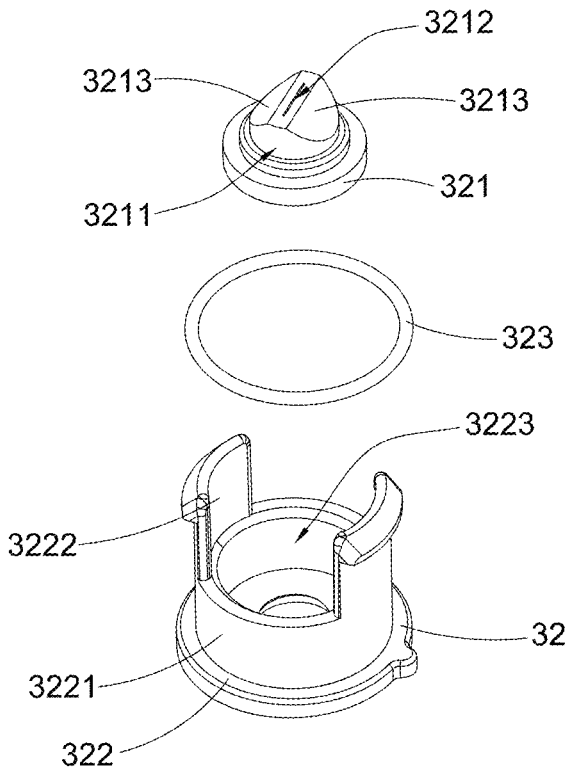
FIG. 17 is an exploded view of a water valve of the handheld garment steamer according to the above preferred embodiment of the present invention.
Figure 18:
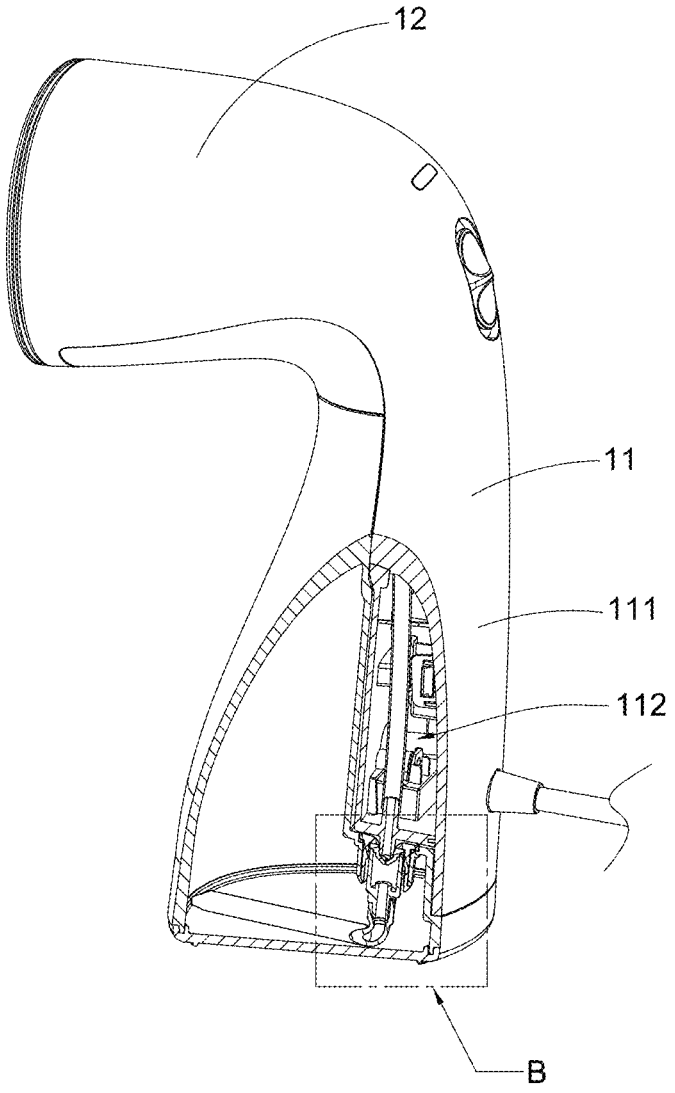
FIG. 18 is an schematic view illustrating the assembly of the water valve of the handheld garment steamer according to the above preferred embodiment of the present invention.
Figure 19:
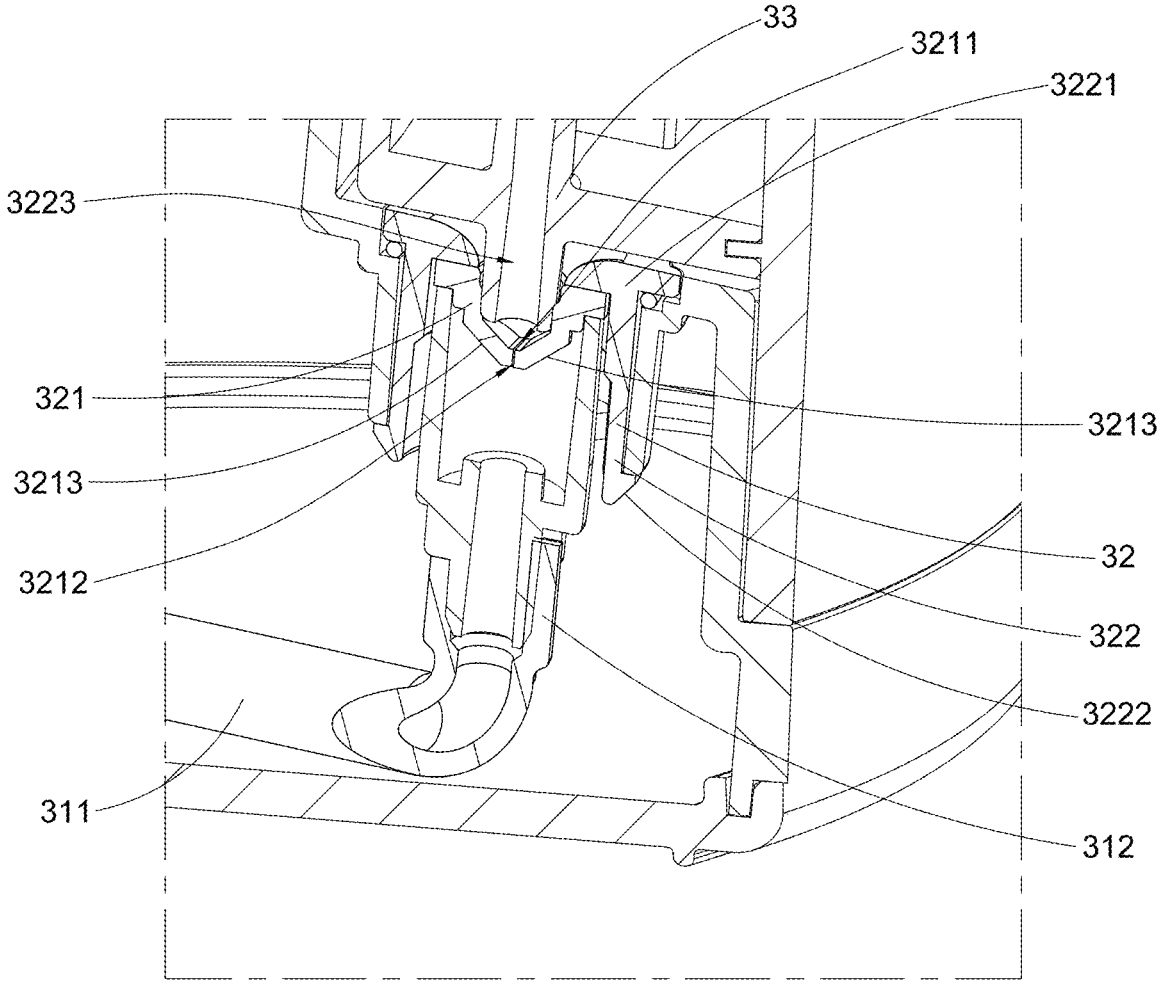
FIG. 19 is a partial enlarged view of area B of FIG. 18.
Figure 20:
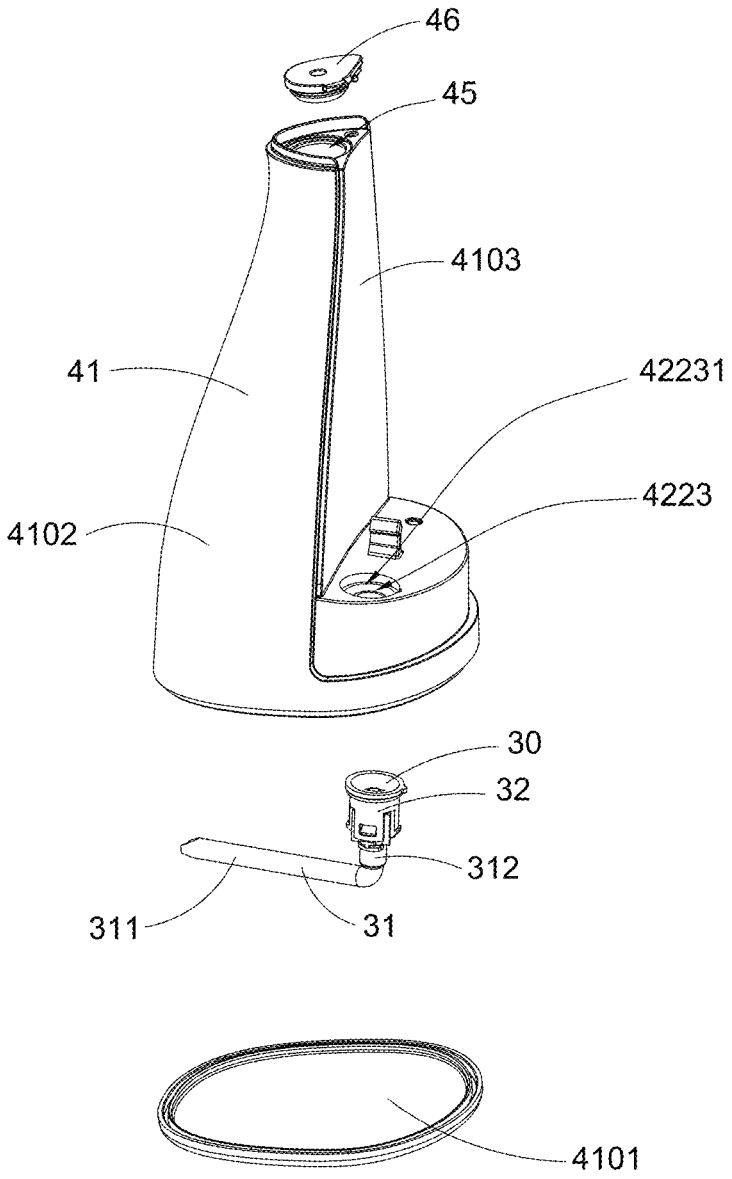
FIG. 20 is a perspective view illustrating an alternative water valve of the handheld garment steamer according to the above preferred embodiment of the present invention.
Figure 21:
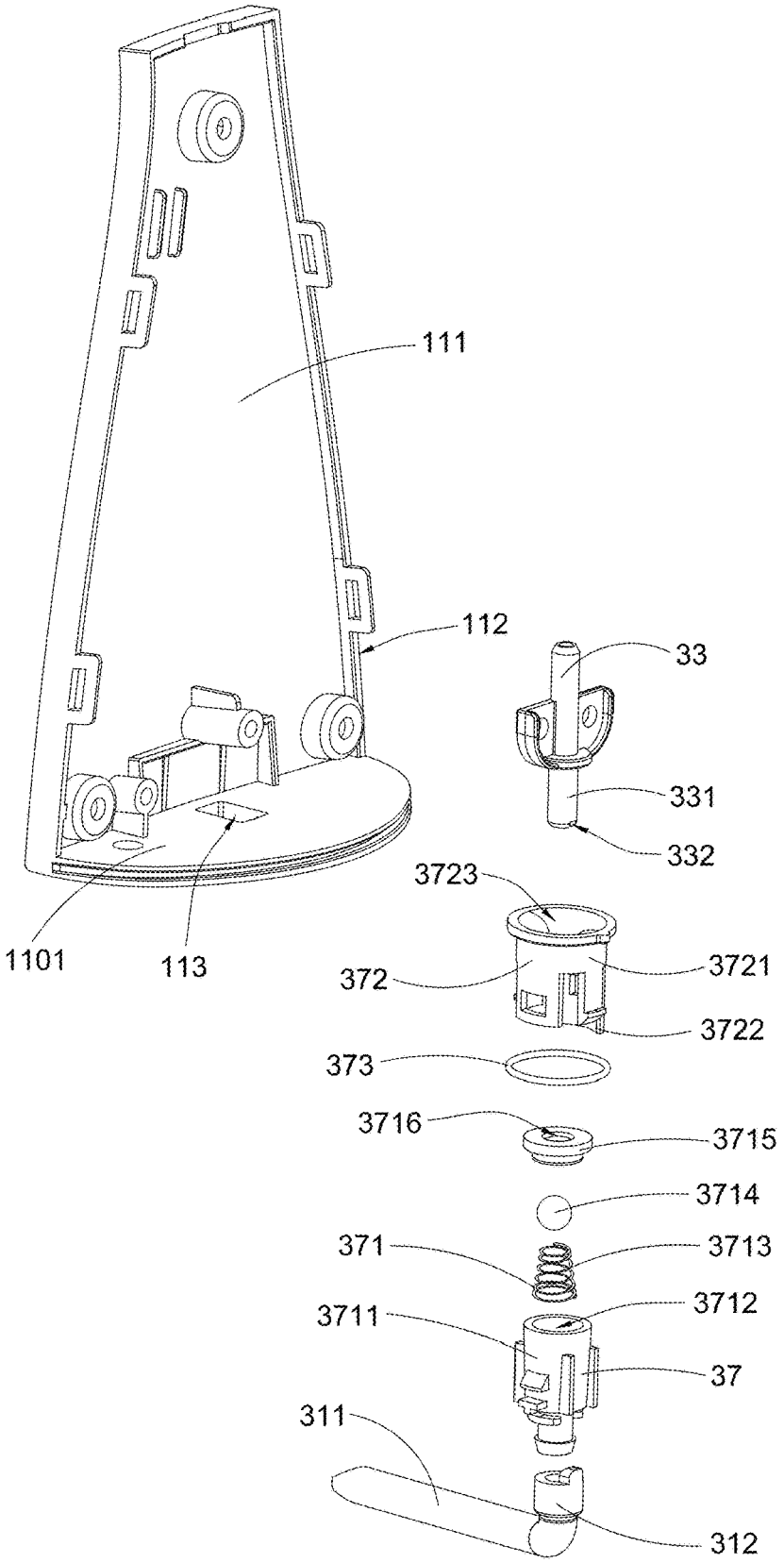
FIG. 21 is an exploded view illustrating the alternative water valve of the handheld garment steamer according to the above preferred embodiment of the present invention.

Alternatively, as shown in FIG. 16, the inserting head 4412 also can be formed as an inserting ball which can be retained in the locking cavity 4422. The ball-shaped inserting head 4412 provides a more evenly distributed contact area within the locking cavity 4422. This ensures that the retention force applied by the locking members 44211 and resilient elements 4424 is uniformly spread, improving overall stability when the water tank 40 and base housing portion 11 are assembled. The spherical design offers less opportunity for the inserting ball to shift or become misaligned within the locking cavity 4422 which can securely hold the ball in place, reducing the risk of accidental disengagement during use.

In addition, a ball shape has a natural rolling ability, allowing for smoother insertion and removal from the locking cavity 4422 compared to a flat or angular head design. When the user applies force to insert or detach the water tank 40 or base housing portion 11, the ball can roll along the guiding surfaces of the locking members 44211, reducing friction and making the process easier. Forming the inserting head as a ball simplifies the geometry of the part. The ball structurally robust and easy to manufacture, ensuring that the component can be produced with high precision and consistency, which is important for maintaining the reliability of the locking unit 44 over time.

Figure 15B:
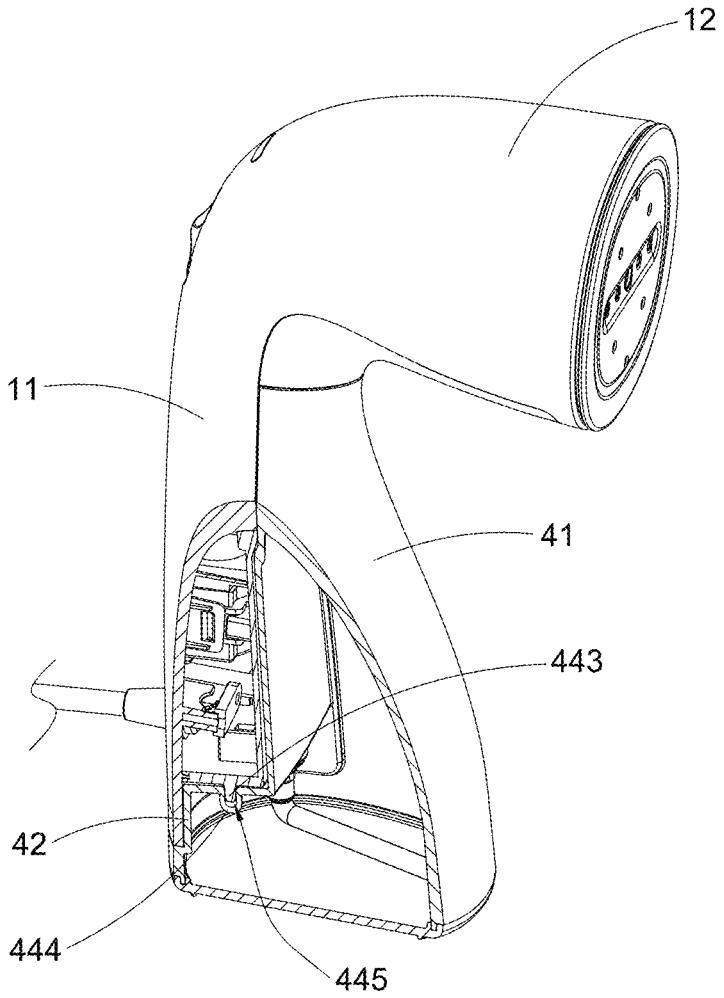
FIG. 15B is a schematic view illustrating the engagement between a mounting pin and a mounting base of the handheld garment steamer according to the above preferred embodiment of the present invention.

As shown in FIG. 15B, the locking unit 44 further comprises a mounting pin 443 which is protruded from the bottom engaging wall 1101 of the base housing portion 11, and a mounting base 444 is formed on the base top wall 4222 and extending into the second receiving cavity 432 defined by the seat tank portion 42. Accordingly, the mounting base 444 has a mounting hole 445 which can be engaged with the mounting pin 443 when the water tank 40 is assembled with the base housing portion 11. The mounting base 444 is extended into the second receiving cavity 432, so that the depth of the mounting hole 445 is ensured for retaining the mounting pin 443 in position while the base top wall 4222 is allowed to have a relatively small thickness. Reducing the thickness of the base top wall 4222 while maintaining sufficient engagement depth for the mounting pin 443, results in a lighter handheld garment steamer with a larger water storing volume of the second receiving cavity 432.

Figure 11:
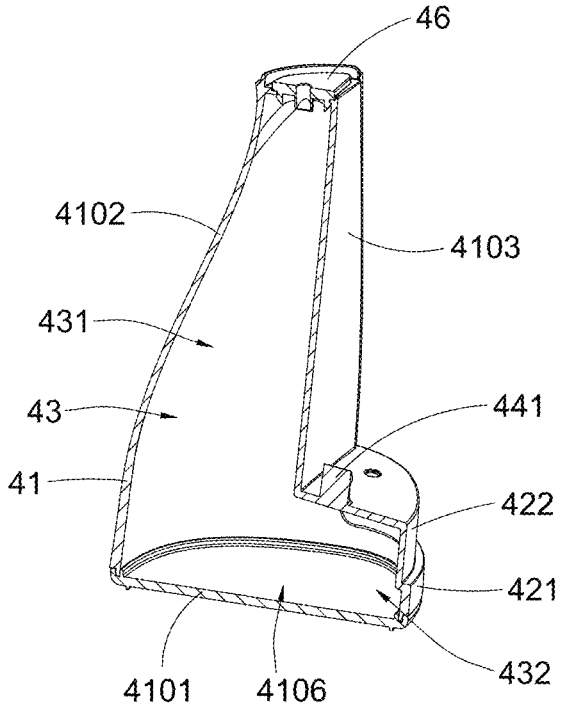
FIG. 11 is a schematic sectional view illustrating the water tank of the handheld garment steamer according to the above preferred embodiment of the present invention.
Figure 12:
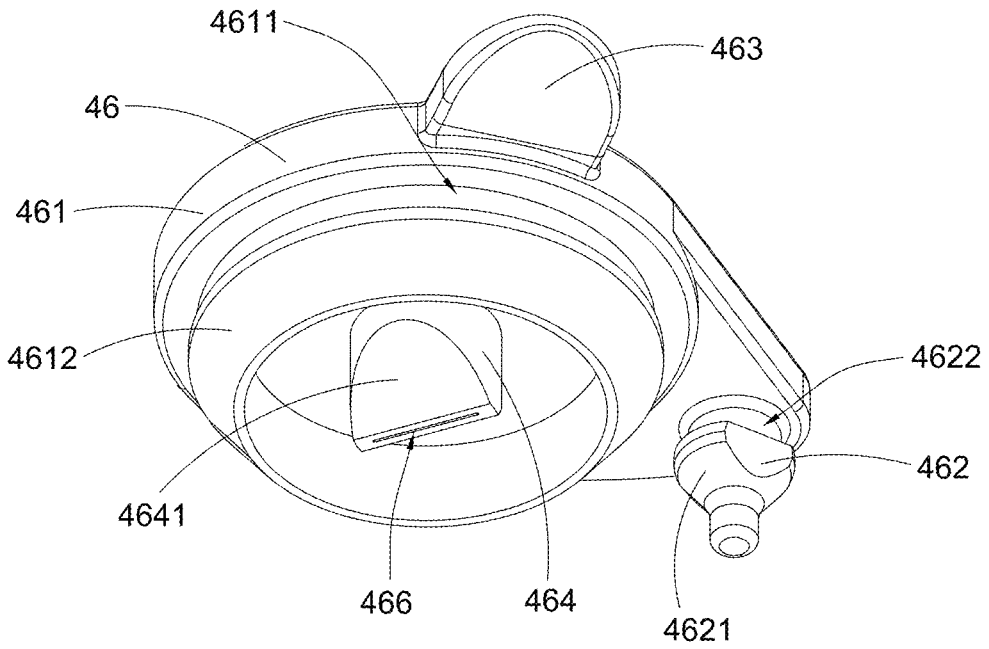
FIG. 12 is a perspective view of a sealing element of the water tank of the handheld garment steamer according to the above preferred embodiment of the present invention.
Figure 13:
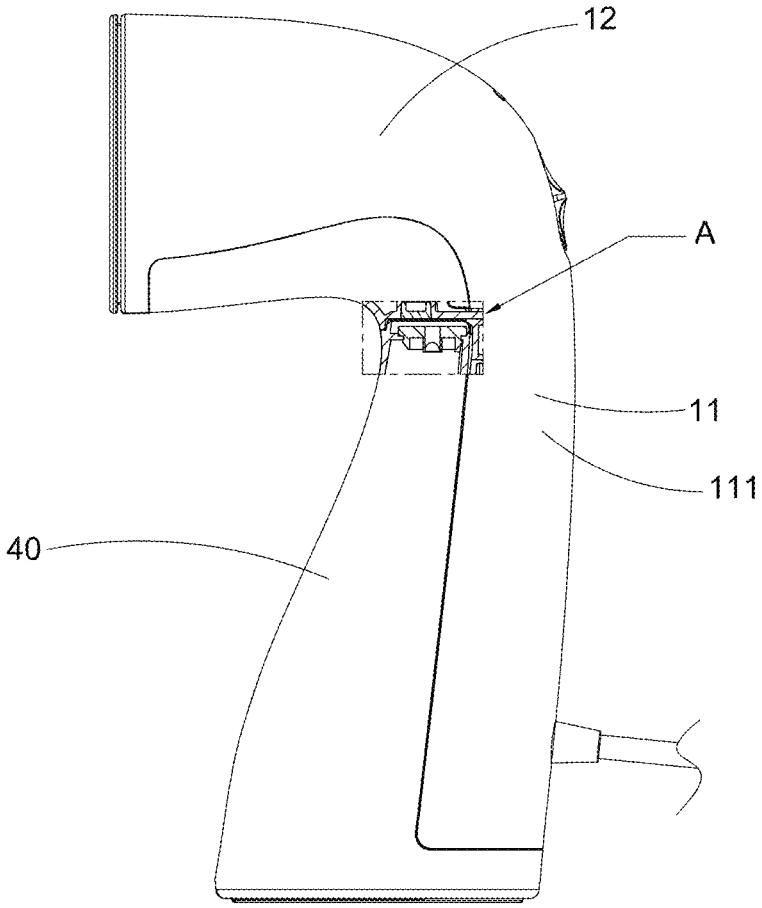
FIG. 13 is a schematic view illustrating the engagement between the water tank and the housing of the handheld garment steamer according to the above preferred embodiment of the present invention.
Figure 14:
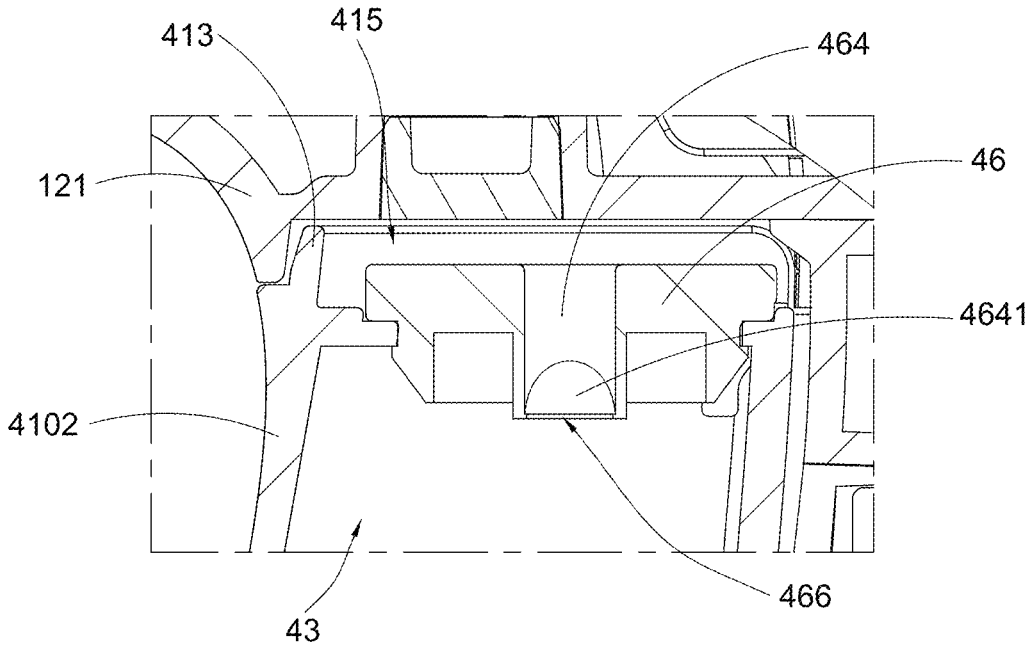
FIG. 14 is a partial enlarged view of area A of FIG. 13.

Referring to FIGS. 11 and 12 of the drawings, the water tank 40 has a refill opening 45 formed in the top wall 4104 of the tank body 41 for filling water into the water storing cavity 43 of the water tank 40, and a sealing element 46 which is coupled to the refill opening 45 for sealing the refill opening 45 after water refill.

In this embodiment, the sealing element 46, which is made of a resilient material such as silicon material or rubber material, comprises a sealing body 461 and a connecting arm 462 which is extended from the sealing body 461. The water tank 40 has a connecting hole 47 formed in the top wall 4104 of the tank body 41 for coupling with the connecting arm 462.

Particularly, the connecting arm 462 has a connecting groove 4621 and comprises an enlarged portion 4622 below the circular connecting groove 4621, when the connecting arm 462 is assembled to the connecting hole 47, a wall around the connecting hole 47 is wound around the connecting arm 462 within the connecting groove 4621, and the enlarged portion 4622 is biasing against an inner wall of the top wall 4104 of the tank body 41, so as to prevent the connecting arm 462 to be detached from the connecting hole 47, and the sealing body 461 is allowed to be pivotally moved with respect to the connecting arm 462, so as to seal or expose the refill opening 45.

The sealing body 461 also has a retaining groove 4611 and comprises a circular retaining portion 4612, when the sealing body 461 is assembled to the refill opening 45, a wall around the refill opening 45 is retained at the circular retaining groove 4611 of the sealing body 461, the circular retaining portion 4612 is biasing against the inner wall of the top wall 4104 of the tank body 41, so as to prevent the sealing body 461 *o* be detached from the refill opening 45.

The sealing element 46 further comprises an operation piece 463 which is extended from the sealing body 461 for a user to hold thereon for driving the sealing body 461 to move, so as to shift the refill opening 45 between an exposed state and an closed state.

As shown in FIG. 12 of the drawings, the sealing element 46 further comprises a ventilation portion 464 integrally extended from the sealing body 461, the sealing element 46 has a channel 465 formed in the sealing body 461 and the channel 465 is extended to the ventilation portion 464. The ventilation portion 464 has a slit 466 which is used to communicate the water storing cavity 43 to the channel 465.

The ventilation portion 464 comprises two inclined extending surfaces 4641 which are aligned with each other, and the slit 466 is defined between the bottom edges of the two inclined extending surfaces 4641, so that the slit 466 can allow the water storing cavity 43 to maintain an atmospheric air pressure during operation.

In other words, the primary function of the slit 466 is to ensure that the water storing cavity 43 remains at atmospheric air pressure. This is crucial for smooth operation, as it allows air to flow into the water storing cavity 43 while water is being drawn out or used for steaming. Without this pressure regulation, a vacuum or pressure buildup could occur, hindering the water flow or causing instability during operation.

The two inclined extending surfaces 4641, positioned to form the slit 466, create a controlled path for air entry, ensuring that pressure inside the water storing cavity 43 remains balanced with the external environment. This prevents the negative pressure that could lead to improper water release, sputtering, or inconsistent steam production. In addition, the two resilient inclined extending surfaces 4641 prevents the slit 466 to be enlarged, so as to prevent the water in the water storing cavity 43 to leakage from the slit 466.

In other words, while allowing air into the water storing cavity 43, the slit 466 also limits the potential for water to escape, as it is positioned in such a way that it primarily facilitates airflow. The precise design of the inclined extending surfaces 4641 and the small size of the slit 466 ensure that water is retained in the cavity, minimizing the risk of leaks while maintaining proper ventilation.

Furthermore, the resilience of the inclined extending surfaces 4641 allows them to flex slightly under pressure but immediately return to their original position. This elasticity ensures that even if there are minor forces acting on the surfaces during the use of the water tank 40, they can absorb the stress without permanently widening the slit 466. This resilience maintains the integrity of the design over time.

Alternatively, the sealing element 46 may comprise a film that is air breathable but does not allow water to pass through, so as to allow the water storing cavity 43 to maintain the atmospheric air pressure.

In addition, the tank body 41 of the water tank 40 comprises an enclosure wall 413 which is vertically extended from the top wall 4104 to define an accommodating groove 414 with a side opening 415, the accommodating groove 414 is used for receiving the sealing element 46, the side opening 415 is used to create some clearance when the water tank 40 is assembled to the base housing portion 11, so as to allow the water storing cavity 43 to be communicated to outside through the slit 466, the channel 465, the accommodating groove 414 and the side opening 415.

As shown in FIG. 7 and FIGS. 17 to 19, the water pump assembly 30 comprises a delivery pipe 31, a water valve 32, a coupling pipe 33, a connecting pipe 34, a pump element 35 and a feeding pipe 36. The delivery pipe 31 is disposed in the water storing cavity 43 of the water tank 40, the water valve 32 is connected to the delivery pipe 31 and is installed to the water tank portion 42 of the water tank 40, the coupling pipe 33 is a rigid pipe which is penetrating the bottom engaging wall 1101 of the base housing portion 11 and can be detachably connected to the water valve 32 when the water tank 40 is assembled with the base housing portion 11, the pump element 35 is disposed in the base housing cavity 112 of the base housing portion 11 and is connected between the feeding pipe 36 and the connecting pipe 34 which is connected to the coupling pipe 33, the feeding pipe 36 is arranged for feeding water to the evaporation assembly 20.

The base part 422 of the seat tank portion 42 has an installing opening 4223 for installing the water valve 32. The installing opening 4223 and the mounting hole 445 are formed at two opposite sides of the retention pin 441.

According to this embodiment, the water valve 32 comprises a valve element 321 which is able to be shifted between an open state and a closed state, an installing element 322 for mounting the valve element 321 to the delivery pipe 31 at the installing opening 4223, and a sealing ring 323 wound around the installing element 322 to enhance the water sealing effect of the water valve 32. The installing opening 4223 has as a top installing groove 42231, the sealing ring 323 is disposed in the top installing groove 42231.

The valve element 321, which is made of a resilient material such as silicon material and rubber material, has a valve channel 3211 and a slit opening 3212 communicated to the valve channel 3211, the vale element 321 comprises two inclined walls 3213 which are aligned with each other, and the slit opening 3212 is formed between bottom edges of the two inclined walls 3213.

The installing element 322, which can be made of a resilient material such as silicon material and rubber material, comprises an installing sleeve 3221 and a plurality of biasing walls 3222 which are spacedly extended from the installing sleeve 3221 for biasing against the delivery pipe 31, the installing sleeve 3221 has a connecting channel 3223 which is communicated to the valve channel 3211.

The slit opening 3212 of the resilient valve element remains naturally closed when no external force is applied, due to the material's inherent elasticity. This creates an effective self-sealing mechanism, ensuring that the valve element 321 stays shut when the water tank 40 is not in use, preventing unwanted water leakage. Additionally, the surface tension of the water further enhances this sealing effect, creating a robust barrier against leaks.

When the water tank 40 is installed with the base housing portion 11, the coupling pipe 33 pushes apart the two inclined walls 3213 which are configured in V-shape. This action directly forces the slit opening 3212 to open, allowing water to flow from the water tank 40 to the pump element 35 efficiently.

As soon as the external force is removed, the elasticity of the valve element 32 causes the two inclined walls 3213 to return to their original positions, and the slit opening 3212 closes automatically. This ensures precise control over water flow, only allowing water to be drawn when required.

The two inclined walls 3213 of the valve element 32 respond only to specific external pressure from the coupling pipe 33, meaning that the valve element 32 opens only when the handheld garment steamer is properly assembled and in use. This on-demand water flow prevents unnecessary water wastage and ensures that the water delivering system is closed when disassembled.

The combination of the closed slit opening 3212 and the inherent surface tension of water forms a highly effective leak-prevention mechanism, even when the water tank 40 is detached from the housing 10 and is subjected to movement or slight pressure fluctuations. The silicone's material properties keep the valve element sealed tightly until deliberate activation.

In this embodiment, the valve structure ensures that when the water tank 40 is detached from the housing 10 and is filled with water independently, it remains leak-proof. The use of a self-sealing valve element 32, featuring walls of V-shaped slopes and a closed slit opening 3212, prevents any water from escaping in this state. This is crucial as it allows the user to handle and transport the water tank 40 without concerns of leakage, maintaining cleanliness and reducing water wastage.

Once the water tank 40 is properly installed onto the main body of the handheld garment steamer, the coupling pipe 33 pushes against the inclined walls 3213, causing the slit opening 3212 to open. This ensures that water flows smoothly and efficiently from the water tank 40 into the pump element 35. The design enables a seamless transition between the sealed state and the open state.

When the water tank 40 is removed from the main body of the handheld garment steamer, the inclined walls 3213 of the valve element 32 automatically reseals due to its elastic properties. This automatic sealing prevents any post-removal water leakage, maintaining a secure closure without requiring manual intervention.

The deliver pipe 31 in this embodiment is embodied as a L-shaped pipe comprising a base pipe portion 311 and a connector pipe portion 312 vertically extended from the base pipe portion 311, the valve element 321 of the water valve 32 is mounted to the connector pipe portion 312.

The L-shaped deliver pipe 31 ensures that even the remaining water at the bottom of the water tank 40 can be efficiently drained. This is particularly useful for ensuring that the water tank 40 is emptied thoroughly, which is important for maintaining cleanliness and preventing stagnation or contamination in the water supply.

A tail end portion 3111 of the base pipe portion 311 is designed with a chamfer opening 3112 to facilitate smoother water flow. In this embodiment, two chamfer opening 3112 are respectively formed at upper and lower sides of the tail end portion 3111. This angled tail design minimizes resistance and allows water to be drawn out more easily. The chamfer opening 3112 ensures that even small amounts of water can be quickly funneled through the base pipe portion 311, reducing the risk of water remaining trapped in the water tank 40.

In addition, The tail end portion 3111 of the base pipe portion 311 is positioned at the lowest point of the water tank 40, ensuring that it can reach and extract the maximum amount of water. This strategic placement guarantees that even in situations where the water level is very low, the tank can still be drained almost completely, leaving minimal residual water behind.

The design is optimized to work efficiently when the handheld garment steamer is used at various ironing angles. Whether the handheld garment steamer is tilted or held at different positions during operation, the L-shaped delivery tube 31 ensures that the water tank 40 can still be drained effectively. This feature makes the system highly versatile and functional, regardless of how the user maneuvers the handheld garment steamer.

Referring to FIGS. 20 to 23 of the drawings, a water pipe assembly according to an alternative mode of the above preferred embodiment of the present invention is illustrated, the water pump assembly 30 comprises a delivery pipe 31, a water valve 37, a coupling pipe 33, a connecting pipe 34, a pump element 35 and a feeding pipe 36. The delivery pipe 31 is disposed in the water storing cavity 43 of the water tank 40, the water valve 37 is connected to the delivery pipe 31 and is installed to the water tank portion 42 of the water tank 40, the coupling pipe 33 is a rigid pipe which is penetrating the bottom engaging wall 1101 of the base housing portion 11 and can be detachably connected to the water valve 32 when the water tank 40 is assembled with the base housing portion 11, the pump element 35 is disposed in the base housing cavity 112 of the base housing portion 11 and is connected between the feeding pipe 36 and the connecting pipe 34 which is connected to the coupling pipe 33, the feeding pipe 36 is arranged for feeding water to the evaporation assembly 20.

The deliver pipe 31 in this embodiment is also embodied as a L-shaped pipe comprising a base pipe portion 311 and a connector pipe portion 312 vertically extended from the base pipe portion 311, the water valve 37 is mounted to the connector pipe portion 312.

More specifically, the water valve 37 comprises a valve element 371 which is able to be shifted between an open state and a closed state, an installing element 372 for mounting the valve element 371 to the delivery pipe 31 at the installing opening 4223 and a sealing ring 373 wound around the installing element 372 to enhance the water sealing effect of the water valve 37. The installing opening 4223 has as a top installing groove 42231, the sealing ring 373 is disposed in the top installing groove 42231. The water valve 37 can be assembled as an integral component before being installed to the water tank 40.

The valve element 371 comprises a channel pipe 3711 having a receiving channel 3712, a spring 3713 disposed in the channel pipe 3711, a pusher member 3714 which is biasing against the spring 3713, a valve sealing ring 3715 biasing against the pusher member 3714.

The installing element 322, which can be made of a resilient material such as silicon material and rubber material, comprises an installing sleeve 3221 and a plurality of biasing walls 3222 which are spacedly extended from the installing sleeve 3221 for biasing against the channel pipe 3711, the installing sleeve 3221 has a connecting channel 3223 which is communicated to the receiving channel 3712.

Figure 22:
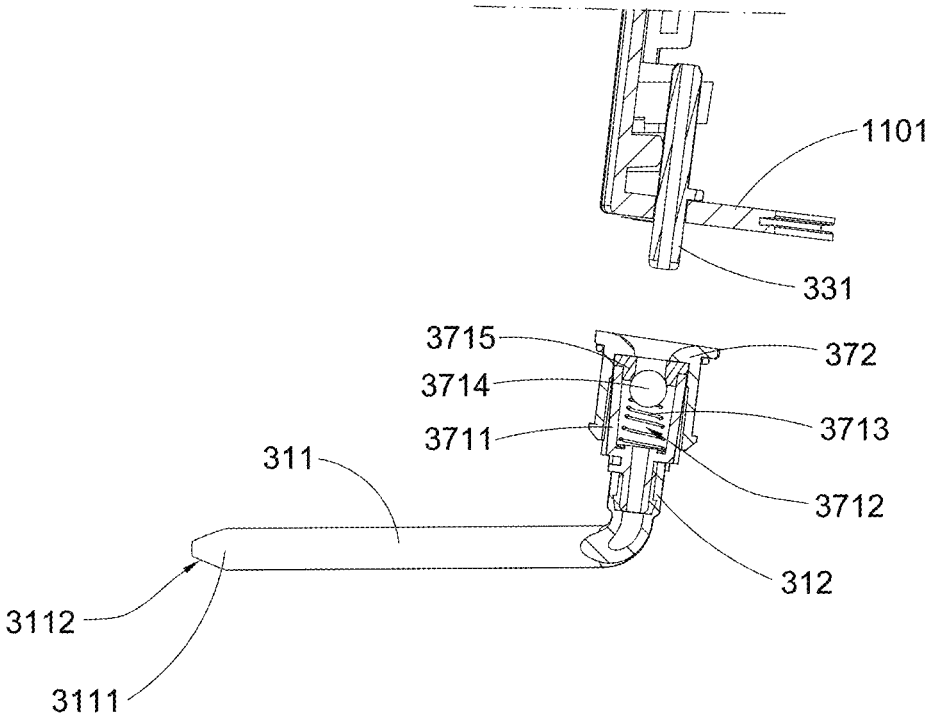
FIG. 22 is a schematic view illustrating the engagement between the water valve and a coupling pipe of the handheld garment steamer according to the above preferred embodiment of the present invention.

As shown in FIG. 22, when the valve element 371 is in an closed state, the spring 3713 which is connected to the channel pipe 3711 applies a supporting force to the pusher member 3714 which can be embodied as a ball, so that the pusher member 3714 is firmly attached to a bottom of the valve sealing ring 3715, so as to block water flow through a communicating opening 3716 of the valve sealing ring 3715.

Figure 23:
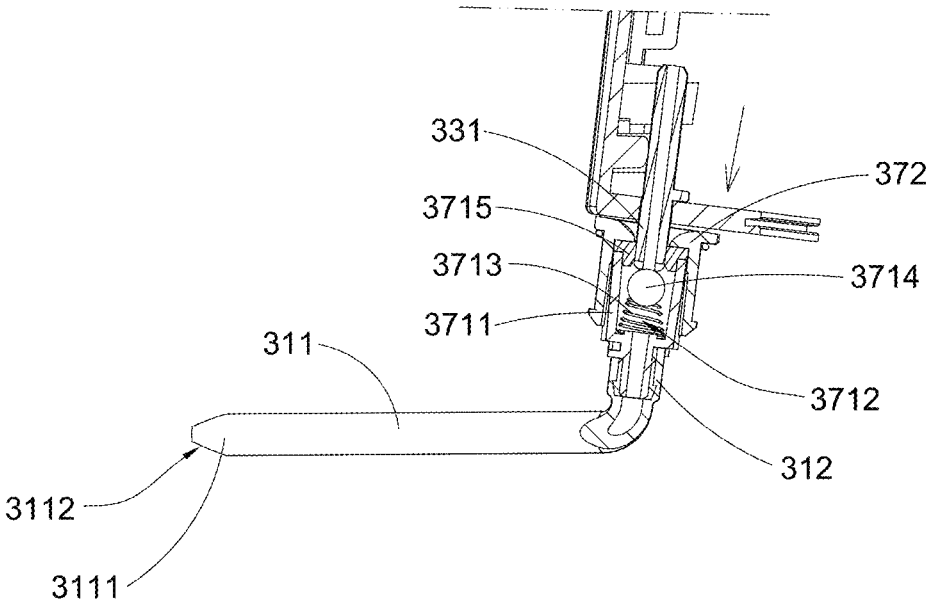
FIG. 23 is a schematic view illustrating the water valve being assembled with the coupling pipe of the handheld garment steamer according to the above preferred embodiment of the present invention.

As shown in FIG. 23, when the coupling pipe 33 is assembled to the water valve 37, a bottom end portion 331 of the coupling pipe 33 is inserted through the connecting channel 3223 of the installing element 322 and the communicating opening 3716 of the valve sealing ring 3715, so as to push the pusher member 3714 to move downward, so that the bottom end portion 331 of the coupling pipe 33 has one or more slots 332 which are communicated to the receiving channel 3712 of the channel pipe 3711 which is connected and communicated to the connector pipe portion 312 of the delivery pipe 31, so as to allow the water in the water storing cavity 43 to be supplied to the pump element 35 through the delivery pipe 31, the water valve 37, the coupling pipe 33, the connecting pipe 34.

The valve structure of this embodiment is engineered to prevent any leakage when the water tank 40 is filled with water but not yet connected to the main body of the handheld garment steamer. This ensures that the user can safely handle and transport the water tank 40 without worrying about spills.

Once the water tank 40 is installed on the main machine, the valve element 372 opens efficiently, allowing water to flow smoothly into the evaporation assembly 20 without resistance or delays. The water valve 37 maintains a secure seal both in its detached state and when connected to the steamer body. This double-function sealing system prevents leaks and ensures that the water supply is consistently available to the device when required, preserving both the integrity of the water tank 40 and the handheld garment steamer.

The head part 200 of the handheld garment steamer comprises the head housing portion 12 and the evaporation assembly 20 installed in the head housing portion 12. The evaporation assembly 20 comprises a controller, an evaporation chamber body, and a heating element electrically connected to the controller for heating the water in the evaporation chamber body to generate steam. The controller also can be configured to control the operation of the pump element 35. In addition, a fan unit also may be disposed in the head housing portion 12.

The head housing portion 12 comprises a bottom housing part 121 and a main housing part 122 which is integrally extended from the base housing portion 11. The water tank 40 can be assembled to the base housing portion 11 at a position below the bottom housing part 121. The height of the water tank 40 can be close to a height of the bottom housing part 121 of the head housing portion 12, so that the water storing capacity of the water tank 40 is ensured.

The housing 10 further comprises a steamer head 14 coupled to the head housing part 12, and as shown in FIGS. 25 and 26, a brush head 15 can be detachably mounted to the steamer head 14. The steamer head 14 has one or more steam holes 141 for discharging the steam, the brush head 15 comprises a plurality of brush bristles 151 which help to gently lift and separate fabric fibers, allowing the steam to penetrate deeper into the material. This results in more efficient wrinkle removal and better overall steaming performance, especially for thicker fabrics. The brush bristles 151 also can help remove lint, dust, and loose particles from fabrics while steaming. This dual function of smoothing out wrinkles and cleaning makes the brush head 15 useful for garments that require freshening up, in addition to wrinkle reduction.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A handheld garment steamer, comprising:

a housing comprising a base housing portion and a head housing portion transversely connected to said base housing portion;

a water tank detachably mounted to said base housing portion in a manner that said water tank and said base housing portion form a handle part for a user to hold thereon, wherein said water tank comprises a tank body comprising a lower portion, and a seat tank portion extended from said lower portion of said tank body, wherein said water tank is detachably mounted to said base housing portion in a manner that said base housing portion is supported above said seat tank portion at a side of said tank body, wherein said tank body has a first receiving cavity, said seat tank portion has a second receiving cavity, wherein a height of said second receiving cavity is smaller than a height of said first receiving cavity, wherein said second receiving cavity is communicated to said first receiving cavity to define a water storing cavity of said water tank;

an evaporation assembly installed in said head housing portion; and a water pump assembly for pumping water in said water tank to said evaporation assembly, wherein said water pump assembly comprises a delivery pipe, a water valve, a coupling pipe, and a pump element, wherein said delivery pipe is disposed in said water storing cavity of said water tank, said water valve is connected to said delivery pipe and is installed to said seat tank portion of said water tank at a position under said base housing portion, said coupling pipe is detachably connected to said water valve when said water tank is assembled with said base housing portion, said pump element is operatively coupled to said coupling pipe and is disposed in said base housing portion at the side of said tank body.

2. The handheld garment steamer according to claim 1, wherein said water tank comprises a tank body which comprises an upper portion which is arranged for being gripped by fingers of a holding hand of the user while said base housing portion is arranged for being held in a palm of the holding hand of the user.

3. The handheld garment steamer according to claim 1, wherein said tank body which comprises an upper portion, wherein said upper portion of said tank body has a concave groove for placement of fingers of a holding hand of the user, wherein said upper portion of said tank body comprises a base position at an indented position of said concave groove, a first curved wall extended outward and upward from said base position and a second curved wall extended outward and downward from said base position, so as to form said concave groove.

4. The handheld garment steamer according to claim 1, wherein said tank body comprises a bottom wall, a top wall, an enclosing wall, and an attaching wall, wherein said enclosing wall is connected to said attaching wall to form an integral peripheral wall between said bottom wall and said top wall, wherein said base housing portion comprises a bottom engaging wall, an abutting wall connected to said bottom engaging wall and a surrounding wall connected to said abutting wall and said bottom engaging wall, wherein said abutting wall of said base housing portion is attached to said attaching wall of said tank body when said water tank is assembled to said base housing portion, said surrounding wall of said base housing portion and said enclosing wall form an outer peripheral surface of said handle part.

5. The handheld garment steamer according to claim 4, wherein said seat tank portion comprises a support part and a base part extended from said support part, wherein said base part comprises a base top wall extended from said attaching wall of said tank body for supporting said bottom engaging wall of said base housing portion, wherein said surrounding wall is supported on said support part when said water tank is assembled to said base housing portion, wherein a height of said base top wall is smaller than a height of said top wall of said tank body.

6. The handheld garment steamer according to claim 5, wherein said base housing portion has a bottom groove under said bottom engaging wall for receiving said base part of said seat tank portion, wherein said seat tank portion has a support notch defined above said support part at a side of said base part, wherein said surrounding wall of said base housing portion comprises a lower wall portion that is fitted to said support notch when said water tank is assembled to said base housing portion.

7. The handheld garment steamer according to claim 4, wherein said top wall of said tank body has a refill opening and a connecting hole, wherein said water tank further comprises a sealing element, wherein said sealing element is resilient and comprises a sealing body coupled to said refill opening, and a connecting arm connected to said sealing body and coupled to said connecting hole to allow said sealing body to be pivotally moved to expose said refill opening.

8. The handheld garment steamer according to claim 7, wherein said sealing element comprises a ventilation portion integrally extended from said sealing body and has a channel extending in said sealing body and said ventilation portion, wherein said ventilation portion has a slit which is used to communicate said water storing cavity to said channel.

9. The handheld garment steamer according to claim 8, wherein said ventilation portion comprises two inclined extending surfaces which are aligned with each other, said slit is defined between bottoms of said two inclined extending surfaces.

10. The handheld garment steamer according to claim 8, wherein said tank body comprises an enclosure wall which is vertically extended from said top wall to define an accommodating groove with a side opening, wherein said sealing element is received in said accommodating groove.

11. The handheld garment steamer according to claim 1, wherein said water tank comprises a locking unit for detachably coupling said water tank to said base housing portion, wherein said locking unit is hidden between said base part of said seat tank portion and said base housing portion.

12. The handheld garment steamer according to claim 11, wherein said locking unit comprises a retention pin extended from said base part, a locking mechanism connected to said base housing portion, wherein said retention pin comprises an inserting head, said locking mechanism comprises two locking members defining a locking cavity with an access opening, and two resilient elements connected to said two locking members at two sides of the locking cavity respectively for resetting the two locking members, wherein said inserting head of said retention pin is capable of being inserted into said locking cavity through said access opening.

13. The handheld garment steamer according to claim 1, wherein said water valve comprises a valve element, wherein said valve element, which is made of a resilient material and is connected to said delivery pipe, has a valve channel and a slit opening communicated to said valve channel, said slit opening remains naturally closed due to inherent elasticity of said valve element.

14. The handheld garment steamer according to claim 13, wherein said valve element comprises two inclined walls which are aligned with each other, and said slit opening is formed between bottoms of said two inclined walls.

15. The handheld garment steamer according to claim 1, wherein said seat tank portion has an installing opening, wherein said water valve comprises a valve element and an installing element coupled to said installing opening for mounting said valve element to said delivery pipe, said installing element comprises an installing sleeve and a plurality of biasing walls which are spacedly extended from said installing sleeve for biasing against said delivery pipe, said installing sleeve has a connecting channel which is capable of being communicated to said valve channel.

16. The handheld garment steamer according to claim 1, wherein said water valve comprises a valve element which comprises a channel pipe having a receiving channel, a spring disposed in said channel pipe, a pusher member which is biasing against said spring, and a valve sealing ring biasing against said pusher member.

17. The handheld garment steamer according to claim 16, wherein said coupling pipe comprises a bottom end portion having one or more slots, said bottom end portion of said coupling pipe pushes said pusher member to move away from said valve sealing ring, so as to allow water in said receiving channel to enter said coupling pipe.

18. The handheld garment steamer according to claim 17, wherein said water valve further comprises an installing element which comprises an installing sleeve and a plurality of biasing walls which are spacedly extended from said installing sleeve for biasing against said channel pipe, said installing sleeve has a connecting channel which is capable of being communicated to said receiving channel.

19. The handheld garment steamer according to claim 1, wherein said delivery pipe comprises a base pipe portion and a connector pipe portion transversely extended from said base pipe portion, said water valve is mounted to said connector pipe portion, wherein said base pipe portion comprises a tail end portion having a chamfer opening.

* * * * *